US010648307B2

(12) United States Patent
Grimes

(10) Patent No.: US 10,648,307 B2
(45) Date of Patent: May 12, 2020

(54) SYSTEMS AND METHODS FOR ENHANCED RECOVERY OF HYDROCARBONACEOUS FLUIDS

(71) Applicant: Paul Grimes, Houston, TX (US)

(72) Inventor: Paul Grimes, Houston, TX (US)

( * ) Notice: Subject to any disclaimer, the term of this patent is extended or adjusted under 35 U.S.C. 154(b) by 0 days.

(21) Appl. No.: 16/107,618

(22) Filed: Aug. 21, 2018

(65) Prior Publication Data

US 2018/0355705 A1 Dec. 13, 2018

Related U.S. Application Data

(60) Division of application No. 13/986,464, filed on May 6, 2013, now Pat. No. 10,087,731, which is a continuation-in-part of application No. 12/800,455, filed on May 14, 2010, now abandoned.

(51) Int. Cl.

| | |
|---|---|
| ***E21B 43/24*** | (2006.01) |
| ***E21B 43/16*** | (2006.01) |
| ***E21B 43/30*** | (2006.01) |

(52) U.S. Cl.

CPC ..... *E21B 43/2401* (2013.01); *E21B 43/16* (2013.01); *E21B 43/30* (2013.01)

(58) Field of Classification Search

CPC ..... E21B 43/2401; E21B 36/04; E21B 43/24; E21B 43/30; E21B 43/305; E21B 43/16

See application file for complete search history.

(56) References Cited

U.S. PATENT DOCUMENTS

| | | | |
|---|---|---|---|
| 4,058,979 | A | 11/1977 | Germain |
| 4,199,025 | A | 4/1980 | Carpenter |
| 5,592,028 | A | 1/1997 | Pritchard |
| 6,050,335 | A | 4/2000 | Parsons |
| 6,100,600 | A | 8/2000 | Pfanz |
| 6,918,350 | B1 | 7/2005 | Morse |
| 7,224,080 | B2 | 5/2007 | Smedstad |
| 8,376,039 | B2 | 2/2013 | Zupanick |
| 2004/0113431 | A1 | 6/2004 | Huang |
| 2005/0199387 | A1 | 9/2005 | Wittle et al. |

*Primary Examiner* — Wei Wang

(74) *Attorney, Agent, or Firm* — Matthews, Lawson, McCutcheon & Joseph, PLLC

(57) ABSTRACT

A method for enhanced recovery of hydrocarbonaceous fluids, the method including the steps of creating a plurality of wellbores in a subterranean formation, whereby one or more of the plurality of wellbores may include a directionally drilled portion with solution disposed therein, and an electrode operatively connected with a power source. Other steps include generating an electrical field within the subterranean formation, thereby causing an electrochemical reaction to produce a gas from the solution, such that the gas mixes with hydrocarbonaceous fluids present in the formation and increases pressure within at least one of the plurality of wellbores, the subterranean formation, and combinations thereof, thereby enhancing recovery of the hydrocarbonaceous fluid.

4 Claims, 16 Drawing Sheets

SYSTEMS AND METHODS FOR ENHANCED RECOVERY OF HYDROCARBONACEOUS FLUIDS

CROSS-REFERENCE TO RELATED APPLICATIONS

This application is divisional of U.S. patent application Ser. No. 13/986,464, filed on May 6, 2013, which is a continuation-in-part of U.S. patent application Ser. No. 12/800,455, filed on May 14, 2010. The disclosures of the prior applications are hereby incorporated by reference herein in their entireties.

SPECIFICATION

Field

Embodiments disclosed herein generally relate to systems and methods that enhance the recovery of hydrocarbonaceous fluids. Specific embodiments relate to systems and methods to stimulate a producing formation by using a gas generated from an electrochemical reaction. Other embodiments relate to the use of AC electrolysis in a machined formation adjacent to and/or within a producing formation to generate a gas that permeates into hydrocarbonaceous fluids disposed in the producing formation.

Background

Large deposits of hydrocarbonaceous fluids, such as crude oil, are known to exist in subterranean formations throughout the world. In the past, these fluids were recovered from the formations until the natural energy (e.g., pressure) of the formation expired, at which point the formation was typically abandoned. This primary recovery typically produced as little as 15%-25% of the hydrocarbonaceous fluids within the formation, with the large majority of hydrocarbons left unrecovered, because the economic cost of continued production exceeded the value of the quantity of hydrocarbonaceous fluids recovered. As the value of hydrocarbonaceous fluids increased, secondary recovery processes became economically justifiable for use to increase production from formations.

Secondary recovery may include, for example, a pumping operation that draws previously unrecoverable fluids to the surface. However, these processes vary greatly, and processes that enable successful recovery from one or more formations may not be economical and/or successful when used in conjunction with other formations. In addition, the capabilities of secondary recovery methods are limited. For example, formations that contain hydrocarbonaceous fluids with a low specific gravity, and/or high viscosity, and possess little or no natural energy may be unaffected by secondary recovery. In the absence of formation pressure, even fluids of average viscosity and specific gravity are difficult to produce through secondary recovery methods, without the addition of external energy to the formation.

As such, a great deal of attention has recently been given to various methods of tertiary recovery. Logically, an abundance of tertiary recovery processes consider energy-based techniques that increase the temperature (i.e., reduce viscosity) and/or the pressure of the producing formation, thereby increasing flow. For example, "fire flooding" employs the technique of burning oil "in situ" or within the formation, thereby heating the formation and pressurizing the formation with resultant hot combustion gases.

Gas injection is another example of a tertiary process. Under injection pressures, $CO_2$ gas may be solvent with hydrocarbonaceous fluids, which increases the actual volume of the fluids and also reduces specific gravity and viscosity. Thus, the solvency of the injected gas provides increased formation pressure and less viscous hydrocarbonaceous fluids. $CO_2$ injection into the formation also causes the hydrocarbonaceous fluids to "break out" of the formation matrix, and thereby further promotes increased production. Nevertheless, many tertiary processes, such as gas injection, require extensive and/or cost-prohibitive surface equipment and operations, and may also cause damage to the producing formation that hinders or terminates future production ability.

Some economical tertiary processes include introducing an electric current into the producing formation to cause exothermal heating of the surrounding formation, which lowers the viscosity of hydrocarbonaceous fluids and stimulates flow. Typically, electrodes are connected to an electrical power source and are positioned at spaced apart points within the producing formation, whereby single electrodes are usually disposed in a corresponding wellbore that penetrates into the producing formation. When current passes between the electrodes and/or through the formation, high resistance of the formation causes power to dissipate, which results in a power loss that heats the producing formation and hydrocarbonaceous fluids. However, this process is generally limited to the immediate area involved in the heating process, and is uneconomical and inefficient.

There is a need for economical and readily usable enhanced recovery systems and methods, which beneficially use an electrochemical reaction, but do not require constituent elements within the producing formation. There is a need for an improved process that uses an electrochemical reaction to generate gases that permeate and/or mix with formation fluids, whereby the pressure of the producing formation may be increased and/or viscosity of hydrocarbonaceous fluids reduced, thereby increasing flowability and overall recovery. There is a further need to enhance and optimize recovery over vast and extensive distances of fields.

There is also a need to monitor and optimize systems and methods that use an electrochemical reaction to enhance recovery of hydrocarbonaceous fluids. Other needs include the ability to convert clean renewable energy into ~100% usable energy.

SUMMARY

Advances in directional drilling may now provide the ability to direct electrical current into a solution disposed in a producing formation. Embodiments disclosed herein may provide an electrochemical recovery process that uses horizontally or directionally drilled wellbores in a formation, whereby the wellbores may be filled, at least partially, with an electrolytic solution, such as salt water.

The solution may provide an electrical contact in the solution, such that current may be conducted between electrodes disposed in the wellbores. Alternatively, the wellbores themselves may be configured as electrodes. As such, directional wellbores may be drilled through the formation, whereby the wellbores may become an effective, long, isolated electrode in itself. Through electrodes, current may be introduced into the formation, and once a critical current density is achieved in the solution, a zone of electrochemical activity may propagate through the formation water and/or solution contained in one or more of the wellbores.

The immediate effects within this zone of electrochemical activity include four basic phenomena:

1. The heating of the electrolyte solution,
2. The excitation of water molecules in the formation which in turn causes a breaking of the viscous bond between the oil and the rock matrix,
3. The release of entrained gases in the formation, and
4. The disassociation of gases, such as, for example, free hydrogen and oxygen from the formation water.

Directional drilling may allow recovery processes of the present disclosure to optimally direct the zone of electrochemical activity that may revitalize the formation on a cost-effective, cost basis. The process may enable coverage of a much larger area of the formation relative to previous recovery techniques. These other recovery techniques are frequently limited by faults, fractures, low permeability, and other geological irregularities that hinder the spread of the EOR influence, but because embodiments disclosed herein may propagate the electrochemical reaction, there is no suffrage from these geological effects.

Embodiments of the present disclosure relate, generally, to systems and methods for enhanced recovery of hydrocarbonaceous fluids. Electrodes may be provided into one or more wellbores. The wellbores may include preexisting producing and/or abandoned wellbores, naturally occurring features, or additional wellbores that may be drilled, machined, or otherwise formed, and the wellbores may or may not be fluidly connected to one another. These configurations facilitate and/or improve performance of an enhanced recovery process described herein.

Embodiments include wellbores placed in fluid communication and/or electrochemical communication through the creation of a machined flow path(s) therebetween. For example, horizontal drilling or similar methods for forming flow paths may be used to interconnect two or more wellbores. In an embodiment of the disclosure, three wellbores, having electrodes therein, may each be provided in fluid communication with one another.

A solution, such as brine or a similar generally conductive fluid is pumped or otherwise provided within the machined flow path, such that the electrodes extend at least partially therein. A power source operatively connected to the electrodes is then actuated to produce an electrical field therebetween. In an embodiment of the disclosure, generation of the electrical field may include application of alternating current to the solution.

Other embodiments may include creating an artificial subterranean formation at least partially underneath a producing and/or abandoned formation containing hydrocarbonaceous fluids. A fluid, such as brine, disposed in the artificial formation may be reacted to form a gas (i.e., hydrogen), which may permeate into the producing formation to increase the pressure therein and/or decrease viscosity of the hydrocarbonaceous fluids.

Embodiments disclosed herein may be used to increase a formation pressure, or otherwise alter flow characteristics of fluids in the formation. This may include, for example, a tertiary recovery process that establishes an electrical current flow within a formation via one or more electrodes that extend into the formation. The current flow may generate a zone of electrochemical activity in the formation that causes an electrochemical reaction with solutions disposed in the formation, thereby generating volumes of free gases to increase the formation pressure.

Other embodiments disclosed herein may be directed to a system for enhanced recovery of hydrocarbonaceous fluids. The system may include a first wellbore with a first electrode, as well as a second wellbore with a second electrode, where the wellbores may be configured such that the second wellbore may be mechanically isolated from the first wellbore. There may be a solution disposed within each of the first and the second wellbores, such that the first electrode and the second electrode may at least partially contact the solution. There may be a power source operatively connected to the first electrode and the second electrode, and configured to produce an electrical field therebetween. The electrical field may create or otherwise cause an electrochemical reaction within the solution to create a gas. As such, the electrical field may electrochemically connect together, at least partially, the first wellbore and the second wellbore.

Embodiments disclosed herein provide for a system for enhanced recovery of hydrocarbonaceous fluids that may include a first wellbore configured with a first electrode, and a second wellbore comprising a second electrode. The second wellbore may be mechanically isolated from the first wellbore. There may be a solution disposed within each of the first and the second wellbores, and the first electrode and the second electrode may at least partially contact the solution. There may be a power source operatively connected to the first electrode and the second electrode, and configured to produce an electrical field therebetween. The electrical field may cause an electrochemical reaction within the solution to create a gas, whereby the electrical field may electrochemically connect together, at least partially, the first wellbore and the second wellbore.

Further embodiments may include a third wellbore mechanically isolated from the first wellbore and the second wellbore, the third wellbore having a third electrode operatively connected to the power source, and at least partially in contact with solution disposed therein.

Other embodiments disclosed herein relate to a method for enhanced recovery of hydrocarbonaceous fluids. The method may include the step of creating a plurality of wellbores in a subterranean formation. Each of the plurality of wellbores may include a directionally drilled portion with solution disposed therein, and an electrode operatively connected with a power source. The method may also include the step of generating an electrical field within the subterranean formation, thereby causing an electrochemical reaction to produce a gas from the solution, such that the gas may mix with hydrocarbonaceous fluids present in the formation and increase pressure within at least one of the plurality of wellbores, the subterranean formation, and combinations thereof.

The step of generating the electrical field may include providing alternating current to the solution, whereby each of the plurality of wellbores may be electrochemically connected together.

The electrochemical activity further enhances flow characteristics of formation fluids by lowering the viscosity of the fluids. The increased formation pressure acts to drive the hydrocarbonaceous fluids into a producing wellbore. The process may also release fluids from the earth formation matrix that are within the zone of electrochemical activity.

Other aspects and advantages of the disclosure will be apparent from the following description and the claims.

DETAILED DESCRIPTION

Figure 1A:
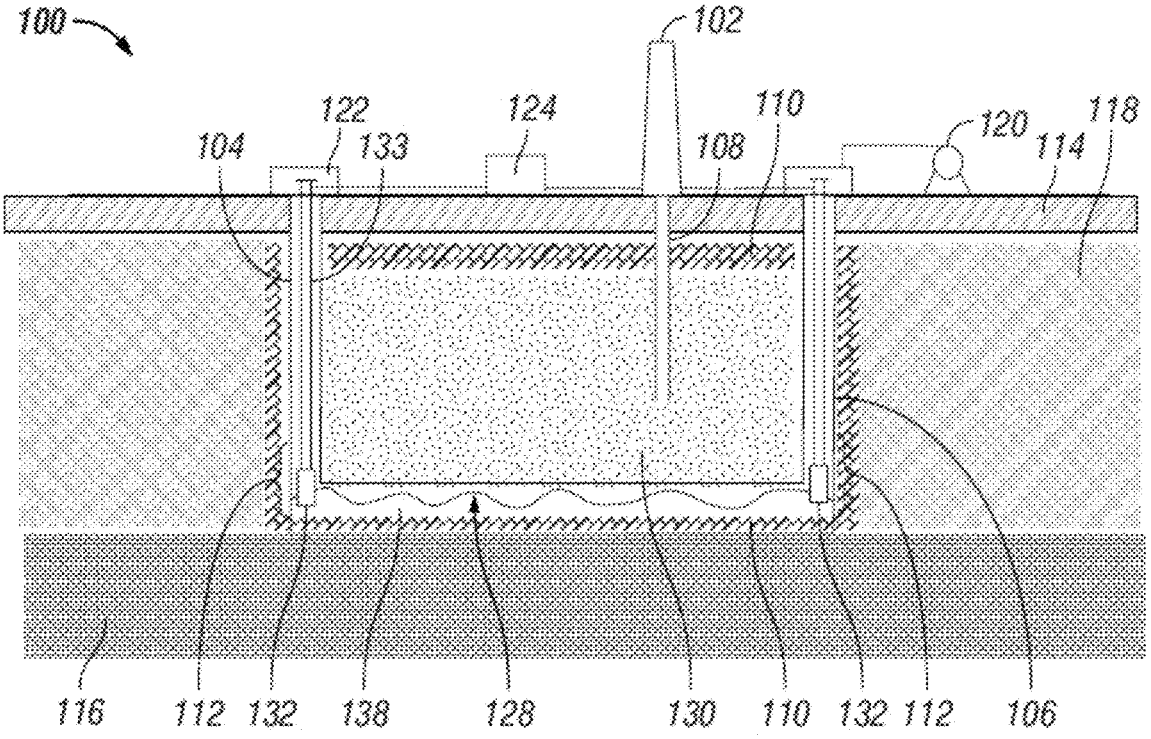
FIGS. 1A and 1B depict multiple views of a various embodiments of a system for enhanced recovery of hydrocarbonaceous fluids, in accordance with embodiments disclosed herein.

Embodiments of the present disclosure will now be described in detail with reference to the accompanying Figures, which may include like elements in various Figures denoted by like reference numerals for consistency. Figures are not necessarily related to any particular scale or size. The detailed description may also set forth specific details in order to provide a more thorough understanding of the claimed subject matter. However, it should be apparent to one of ordinary skill in the art that the embodiments described may be practiced without these specific details. In other instances, well-known features have not been described in detail to avoid unnecessarily complicating the description.

In addition, directional terms, such as "above," "below," "upper," "lower," etc., are used for convenience in referring to the accompanying drawings. In general, "above," "upper," "upward," and similar terms refer to a direction toward the earth's surface from below the surface along a wellbore, and "below," "lower," "downward," and similar terms refer to a direction away from the surface along the wellbore (i.e., into the wellbore), but is meant for illustrative purposes only, and the terms are not meant to limit the disclosure.

Referring now to FIGS. 1A-1F, multiple side and perspective views of various embodiments of a system 100 for enhanced recovery of hydrocarbonaceous fluids 130 according to the present disclosure are shown. FIG. 1A shows the system 100 may include features and components readily recognized by one of skill in the art, such as a surface production facility 102 that may produce hydrocarbonaceous fluids 130 from a producing formation 110 by way of a wellbore 108. The producing formation 110 may be surrounded by various non-producing formations, such as overburden 114 bed rock 116, and/or other earthen material 118.

A producing formation may be a formation that produces appreciable amounts of hydrocarbonaceous fluids as a result of primary, secondary, and/or tertiary recovery processes. An appreciable amount of produced fluid may be, for example, one or more barrels a day. A non-producing formation may be a formation incapable of producing appreciable amounts of hydrocarbonaceous fluids from primary, secondary, and/or tertiary recovery means. An artificial (e.g., man-made, machined, drilled, etc.) formation may advantageously be formed, at least partially, in the producing formation, the non-producing formation, or combinations thereof.

For a formation to be productive, a pressure differential is typically needed between the producing formation and the wellbore. Energy for the pressure differential may be supplied naturally in the form of gas, either free or in solution, evolved under a reduction in pressure. When the natural energy forces within the producing formation are insufficient to overcome any retardant forces within the formation, external energy must be added.

Thus, to enhance the recovery of the producing formation 110, an artificial formation 112 may be formed within (e.g., in the vicinity of, as part of, etc.) the producing formation 110, and the artificial formation may include, for example, one or more wellbores drilled therein. In one embodiment, the artificial formation 112 may include a first wellbore 104 in fluid communication with a second wellbore 106 as a result of a conduit 128 formed therebetween.

Wellbores 104, 106 and conduit 128 may be formed with conventional drilling methods, such that the wellbores 104, 106 and conduit 128 may be pressurized (including use of wellheads 122, etc.), cased, cemented, perforated, etc., as would be understood to one of skill in the art. In some embodiments, the conduit 128 may be a substantially horizontally drilled wellbore. It should be understood that in certain embodiments, at least part of the artificial formation 112 may be left uncased, uncemented, or otherwise unmodified. For example, the conduit 128 may be drilled through stable strata of the producing formation 110, such that casing and/or cementing is not required.

In an embodiment, the wellbores 104, 106 and/or the conduit 128 may be at least partially disposed within or through the producing formation 110, such that the wellbores 104, 106 and/or conduit 128 are independently or simultaneously usable for production of hydrocarbonaceous fluids 130. The artificial formation 112 may be formed in the presence of pre-existing aqueous solutions, such as saltwater, brine, etc. Alternatively, one or more pumps 120 may be configured to convey a surface solution from a source (not shown) to the artificial formation 112. The source may include, for example, a storage tank at the surface or an underground reservoir in communication with the pump.

The artificial formation 112, including any of the formation 112 components, such as conduit 128, may be formed in any portion of the producing formation 110. Although FIG. 1A illustrates the conduit 128 near the bottom of the producing formation 110, the conduit 128 may be formed through a middle region, or through an upper region (near the overburden 114 or the surface), such that the location of where the conduit 128 is formed is not meant to be limited to any specific location. FIG. 1B illustrates by way of example the conduit 128 may be disposed in a general middle region of the producing formation 110.

The producing formation 110 may be configured with a fresh water flood or a gas injection process (e.g., carbon dioxide injection), such that embodiments disclosed herein may readily provide for the conversion of these processes to that of a saltwater flood (or flood with other comparable electrolyte). The saltwater flood may be accomplished to provide an electrolytic path or electric circuit formed within the producing formation 110.

The wellbores 104, 106 may each have an electrode 132 disposed therein. As illustrated, the electrodes 132 may be located near the bottom of the wellbores 104, 106, such that the electrodes 132 may extend at least partially into the solution 138. Although FIGS. 1A and 1B illustrate two electrodes 132, it should be understood that any number and configuration of electrodes 132 within any number or configuration of wellbores may be provided in contact with the solution 138. For example, the wellbores themselves may be configured as an at least partial or entire electrode. In another embodiment, the electrodes may extend the entire length or part of the length of the vertical and/or deviated portions of the wellbore. This may be accomplished, for example, by electrically insulating a portion of an electrical conductor from its surroundings and/or the solution and maintaining a desired length of the conductor uninsulated, allowing current to be conducted through the solution along the uninsulated portion of the conductor.

Any of the electrodes 132 may be made of electrically conducting materials, such as, for example, aluminum or stainless steel. However, other materials are also possible, such as graphite or other semi-conductive material. The electrodes may be any type of electrode known in the industry, such as the electrode(s) described in either of U.S. Pat. Nos. 4,084,639 and 4,199,025, incorporated by reference herein in their entireties. The electrodes 132 may be, for example, metallic electrodes that are long enough so that the lower ends of each may be immersed in the solution 138. The upper ends of the electrodes 132 may be connected by suitable leads (not shown) to an electrical power source 124.

The electrodes 132 may be disposed within the wellbores 104, 106 (and any solution 138 present in the wellbores) in any fashion. For example, the electrodes 132 may be coupled to the end of a tube string 133 or similar elongate member. The tube string 133 may include various components, such as downhole tools, sliding sleeves, conduits, connectors, etc. The tube string 133 may include portions that are configured with electrically non-conducting material, such as fiberglass, plastic, or other generally non-conductive materials.

Hydrocarbonaceous fluids are generally poor conductors, while an electrolyte, such as brine, is a good conductor. Since an electric current will follow the path of least resistance, current applied to the electrodes 132 will flow directly through the solution 138 that is between the electrodes 132. The flow of current may tend to heat the solution 138 in accordance with the amount of solution 138 disposed therebetween, as well as the magnitude of current being applied to the electrodes 132. The heated solution may function as a heater with respect to the fluids 130 within the producing formation 110, whereby the viscosity of the fluids 130 may be decreased, and the flow characteristics of the fluids 130 in the formation 110 may be enhanced.

The electrodes 132 may be operatively connected with a power source 124, which may be located at the surface or another location in electrical communication with the electrodes 132. The power source 124 may be used to create an electric field via an electric circuit created by the power source 124, electrodes 132, and solution 138, as described below. The power source 124 may be of appropriate size and capacity in order to generate electric current that may be conducted into the wellbores 104, 106, and into the solution 138. Components connected between the power source, the wellbores, the electrodes, etc., may be fully insulated from any of the formation(s) in order to isolate the electrical current path, as necessary or desired.

In one embodiment, the power source 124 may be any conventional power source, such as a battery or steam/furnace turbine-generator. In another embodiment, the power source 124 may be a non-conventional power source, such as a renewable (i.e., green, clean, etc.) energy source. For example, there may be one or more wind turbines that together may collectively form a wind farm (not shown).

As known to one of ordinary skill in the art, a wind farm may be a group of wind turbines in the same approximate location that may be used for production of electric power. Individual turbines may be interconnected with a voltage power collection system, whereby electrical current, which is produced by the turbines, may be transferred from the wind farm (via the power system) to the electrodes 132, and into the solution 138. Thus, with a renewable source, "green" energy is used, thereby eliminating the need to obtain power from a conventional source (e.g., burning fossil fuels). Furthermore, the ability to store and/or covert the green energy into formation energy (i.e., increased formation pressure and/or decreased viscosity) is advantageous compared to other renewable energy processes that lose energy by inefficient mechanical processes and/or transfer of energy to an energy grid.

As such, a "green" embodiment may include the use of onsite wind power, or other renewable power, as the source of electricity for the electrochemical reaction. As such, the systems and methods described herein may enjoy extremely low power costs over the long term. Because some green power may not be reliable (e.g., wind power may be intermittent and somewhat unpredictable), other embodiments disclosed herein entail recharging the formation with energy, such that the system effectively creates a large geologic battery.

This is incredibly advantageous for the long term outlook of the hydrocarbon based economy. For example, the consideration of the purported future development of a hydrogen economy is hampered by the present realities of cost and the practical limitations of battery technology. However, it is now the case that once hydrocarbonaceous fluids have been substantially recovered, embodiments disclosed herein may still provide for a tremendous economic, environmental, and strategic opportunity: a geologic battery capable of storing hydrogen that has been converted through the use of energy derived from renewable power.

In some embodiments, any of the wellbores may be formed with perforations (not shown), which may be present in the casing and/or the artificial formation 112. The perforations may allow injection of brine or other fluids from the surface into the artificial formation 112. As such, the electrodes 132 may also have perforations disposed therein. Accordingly, fluid injection may occur by the conveyance of pressurized fluid through the tube string 133, out the electrode perforations, and into the artificial formation 112.

In some embodiments, depending on the construction of conduit 128, the wellbores 104, 106 may allow fluids 130 from the producing formation 110 to enter the wellbores and make contact with electrodes 132. Upon application of the electrical current from the power source 124 to the electrodes, an electric current may be passed between the electrodes 132 and into the producing formation 110 because the fluids 130 may form an at least partial conductive path.

The action of the electrical current passing through the circuit formed by the electrodes 132, the power source 124, and the solution 138 (and/or fluid 130) may heat the formation(s) 110 and/or 112 as a result of the resistive properties of solution 138 and formation(s) 110 and/or 112. In addition, the electrochemical reactions may provide increased internal pressure within the formation 110 to thereby drive hydrocarbonaceous fluids 130 into a producing wellbore 108. The electrochemical reaction may, for example, increase the formation pressure as much as 300 psi over a large area.

The electrochemical action within the formation(s) may produce at least the following phenomena:

1. reduction in the viscosity and specific gravity of the hydrocarbonaceous fluids in the formation, thereby enhancing the flow characteristics of the fluids;
2. generation of large volumes of free gas in the formation due to electrochemical action with the solution;
3. release of the hydrocarbonaceous fluids from the earth formation matrix; and
4. production of heat within the formation matrix in the area traversed by the current.

Figure 1C:
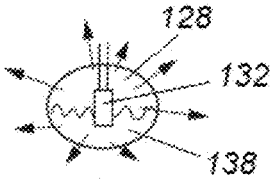
FIG. 1C shows a cross-sectional view of a conduit usable in one of the systems of FIGS. 1A and 1B, in accordance with embodiments disclosed herein.
Figure 1B:
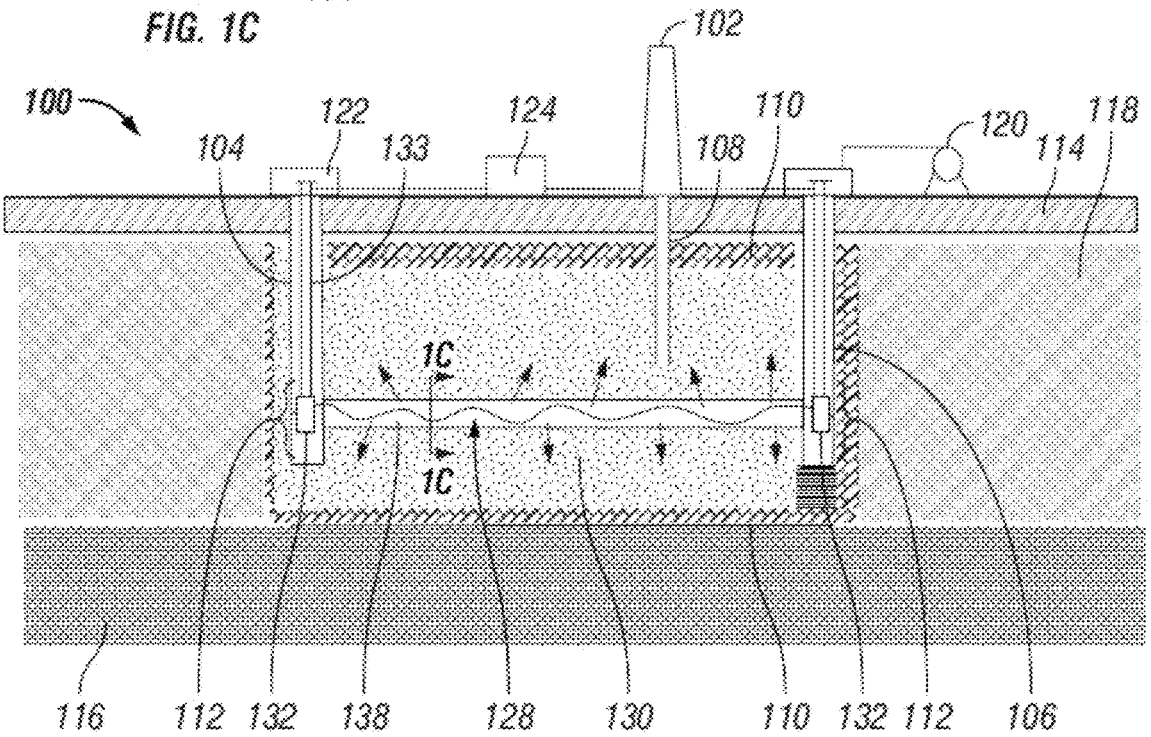

As shown by FIG. 1C, pressure within the wellbore(s) may be sufficient enough to disperse solution 138 (and/or gas formed by electrolysis) out into the producing formation 110. In one embodiment, the solution 138 may disperse outwardly from the artificial formation 112 in any direction. This may result, in one example, because the pressure within the producing formation 110 is insufficient to drive fluids 130 into the artificial formation 112. Conversely, pressure within the artificial formation 112, as a result of increased pressure, such as from pump 120, may cause fluids within the artificial formation 112 to enter the producing formation 110. The dispersal of fluid from the conduit 128 may be, for example, in any outward direction from the conduit 128, including 360-degree radial direction.

The ability to drive solution 138 into the producing formation 110 helps broaden the area of where the electrolysis process may occur. Thus, the electrochemical reaction may occur within the formation 110 in an area that is much greater than the area defined by the conduit 128. The extra pressure of the solution 138 (via the pressurization of the artificial formation 112) may also provide additional pressure to the formation 110. This may create a synergistic effect that helps further enhance the recovery of the hydrocarbonaceous fluids 130 because the extra pressure may facilitate the movement of the fluids 130 toward the wellbore 108.

Figure 1D:
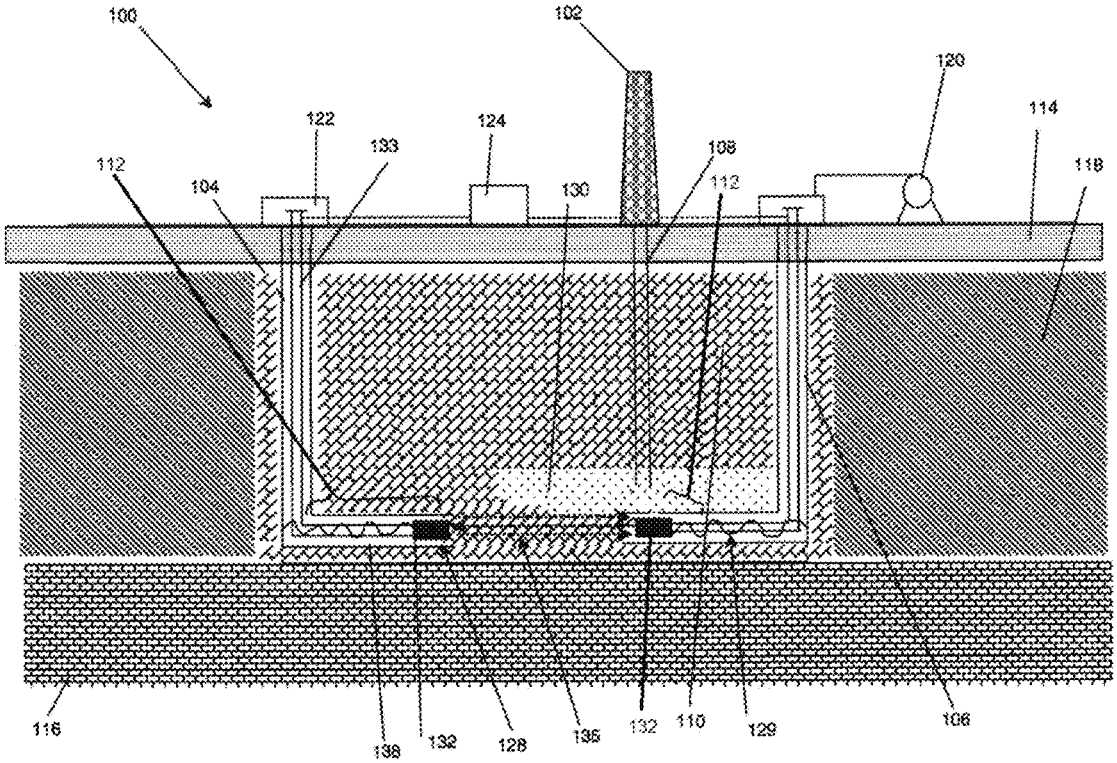
FIGS. 1D, 1E, and 1F depict multiple views of systems for enhanced recovery of formation fluids that have mechanically isolated wellbores, in accordance with embodiments disclosed herein.
Figure 1E:
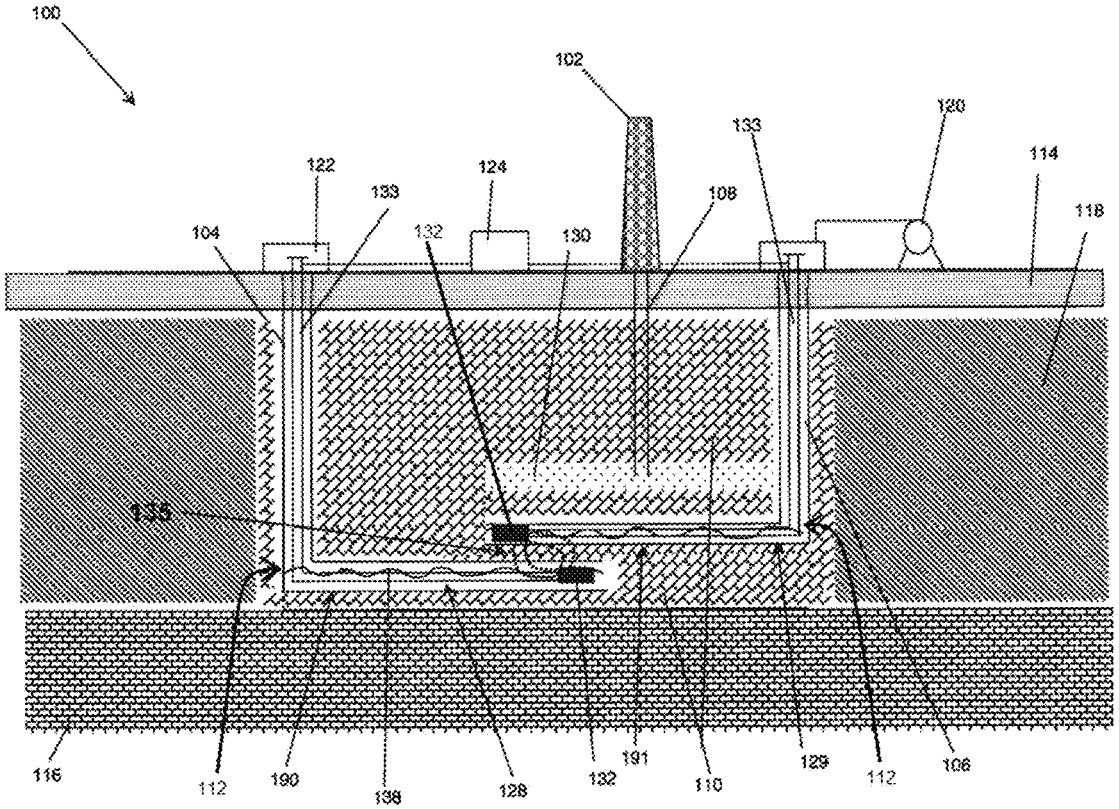
Figure 1F:
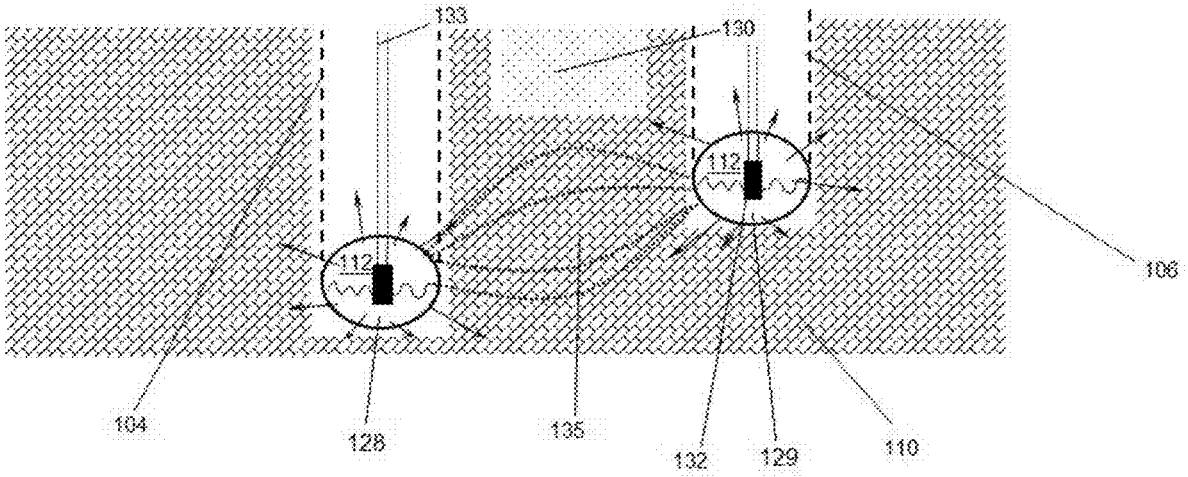

Although embodiments presently disclosed may include any of the wellbores fluidly connected with one or more additional wellbores, FIGS. 1D, 1E, and 1F together illustrate additional embodiments where one or more wellbores are mechanically disconnected or isolated from one another (e.g., not connected by conduits, wellbores, etc.). For example, there may be formation 110 between, at least partially, each of the wellbores 104 and 106 and conduits 128 and 129, respectively.

As shown, the wellbores 104, 106 and/or the conduits 128, 129 may be at least partially disposed within or through the producing formation 110. Although the formation 110 may provide a resistive barrier to establishing an electric circuit between electrodes 132, the formation may not be terminally or infinitely resistive, and the circuit may still be completed, as illustrated by circuit field lines 135. As another example, FIG. 1E illustrates an "offset" configuration of directionally drilled portions, where the wellbores 104 and 106 may extend past one another, or may have portions adjacent one another. Accordingly, the first wellbore 104 may include a first directionally drilled portion 190, and similarly the second wellbore 106 may include a second directionally drilled portion 191. There may also be additional wellbores with directionally drilled portions, such as the third wellbore configured with a third directionally drilled portion (not shown).

The wellbores 104, 106 may each have an electrode 132 disposed therein. As shown, the electrodes 132 may be located near the bottom or end of the wellbores 104, 106, and the electrodes 132 may extend at least partially into solution 138. Although the formation 110 may provide a resistive barrier to the generation of the electric circuit between electrodes 132, the formation may not be terminally resistive, and the circuit may still be completed, as illustrated by circuit field lines 135.

Although FIG. 1D or 1E illustrate two wellbores, each having an electrode 132, it should be understood that any number and configuration of electrodes 132 within any number or configuration of wellbores may be provided within the formation and/or in contact with solution 138. For example, a third wellbore may be disposed in the producing formation, the third wellbore (404A, FIG. 4F) also having an electrode therein, and a conduit that may not be fluidly connected and/or mechanically connected with other conduits or wellbores (not shown). As such, the wellbores may be mechanically isolated from other wellbores. In an embodiment, any of the wellbores may be mechanically isolated from one or more other wellbores, and at the same time, be in fluid and/or electrical communication. The wellbores may be configured in a geometric configuration that may be substantially symmetrical.

In some embodiments, any of the wellbores may be formed with perforations (not shown), which may allow injection of brine or other fluids from the surface into areas around the wellbores. As such, the electrodes 132 may also have perforations disposed therein. Accordingly, fluid injection may occur by the conveyance of pressurized fluid through one or more tube strings 133, out the electrode perforations, and into the conduits 128, 129, and/or out into the formation 110.

In some embodiments, depending on the construction of conduits 128 and 129, the wellbores 104 and 106, respectively, may allow fluids 130 from the producing formation 110 to enter the wellbores and make contact with electrodes 132. Upon application of the electrical current from the power source 124 to the electrodes, an electric current may be passed between the electrodes 132, and into the producing formation 110.

The action of the electrical current passing through the circuit formed by the electrodes 132, the power source 124, the formation 110, the solution 138, field 135, etc. may heat the formation(s) 110 as a result of the resistive properties of solution 138 and formation(s) 110. In addition, the electrochemical reactions may provide increased internal pressure within the formation 110 to thereby drive hydrocarbonaceous fluids 130 into a producing wellbore 108.

FIG. 1F shows a side perspective view of the wellbores 104 and 106 with corresponding conduits 128 and 129, respectively, offset from each other. In general, offset wellbores may include, for example, one or more wellbores that extend into the formation in the vicinity of one or more additional wellbores. In an embodiment, one wellbore may be offset from another wellbore, yet close enough so that the formation may complete the circuit between the wellbores, as shown by circuit field lines 135.

The pressure within the wellbore(s) may be sufficient enough to disperse solution 138 (and/or gas formed by electrolysis) out into the producing formation 110 through one or more openings within the wellbore (not shown). In one embodiment, the solution 138 may disperse outwardly in any direction. This may result, in one example, because the pressure within the producing formation 110 is insufficient to drive fluids 130 into the formation 110. The dispersal of fluid from the conduit 128 may be, for example, in any outward direction from the conduit 128, including 360-degree radial direction.

The ability to drive solution 138 into the producing formation 110 may help broaden the area of where the electrolysis process may occur. Thus, the electrochemical reaction may occur within the formation 110 in an area that may be much greater than the area defined by the conduits 128 and 129. The extra pressure of the solution 138 may also provide additional pressure to the formation 110. This may create a synergistic effect that helps further enhance the recovery of the hydrocarbonaceous fluids 130 because the extra pressure facilitates the movement of the fluids 130 toward the wellbore 108.

Figure 2:
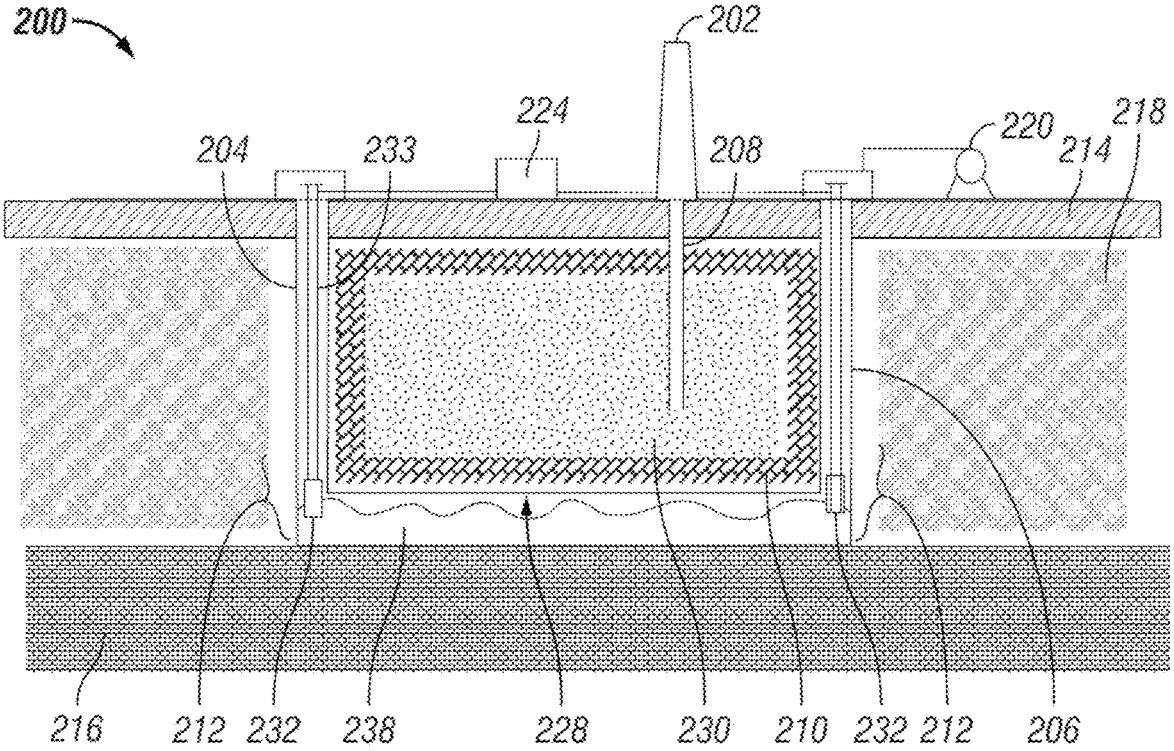
FIG. 2 depicts a side view of an embodiment of a system for enhanced recovery of a producing formation separate from a non-producing formation, in accordance with embodiments disclosed herein.

Referring now to FIG. 2, an embodiment of a system for enhanced recovery of a producing formation separate from a non-producing formation according to embodiments of the present disclosure, is shown. System 200, which may be of a similar construction and/or configuration as the system of FIGS. 1A-1F, may include a surface production facility 202 that produces hydrocarbonaceous fluids 230 from a producing formation 210 by way of a wellbore 208. The electrodes 232 may be operatively connected with a power source 224, such as DC power or AC power, which may be located at the surface. The producing formation 210 may be surrounded by one or more non-producing formations, such as overburden 214, bed rock 216, and/or other earthen material 218.

To enhance the recovery of the producing formation 210, a non-producing artificial formation 212 may be created adjacent (e.g., in the vicinity of, next to, separate from, etc.) and external to the producing formation 210. The artificial formation 212 may include, for example, a plurality of wellbores drilled therein. Thus, in one embodiment, the artificial formation 212 may include a first wellbore 204 in fluid communication with a second wellbore 206, with a conduit 228 formed therebetween.

In some embodiments, the artificial formation 212 may be formed in the presence of pre-existing aqueous solutions, or there may be one or more prime movers (e.g., a pump) 220 configured to convey a surface solution from a source (not shown) to the artificial formation 212. Thus, the wellbores 204, 206 and/or the conduit 228 may have an aqueous solution 238 disposed therein, and each of the wellbores may have an electrode 232 disposed therein and in electrical communication with the solution 238, as previously described.

In other embodiments, any of the wellbores may be formed with perforations (not shown), which may be present in the casing and/or the artificial formation 212. The perforations may allow injection of brine or other fluids from the surface into the artificial formation 212. As such, the electrodes 232 may also have perforations disposed therein. Accordingly, fluid injection may occur by the conveyance of pressurized fluid through a tube string 233, out the electrode perforations, and into the artificial formation 212.

Although not illustrated, the wellbores 204, 206 and/or the conduit 228 may be at least partially disposed within or through the producing formation 110, such that the wellbores 204, 206 and/or conduit 228 are independently or simultaneously useable for production of hydrocarbonaceous fluids 230, in addition to creation of the electric field within the solution 238. Thus, a non-producing artificial formation may be converted to a producing artificial formation, if desired.

Figure 3:
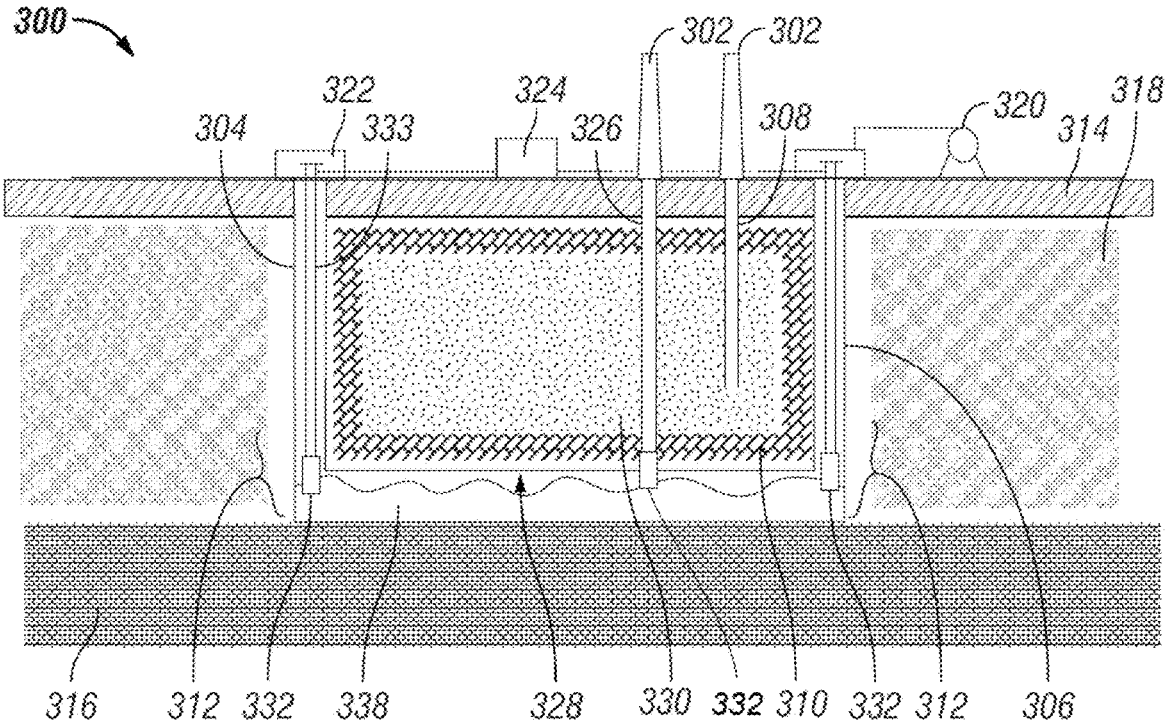
FIG. 3 depicts a side view of an alternate embodiment of a system for enhanced recovery of hydrocarbonaceous fluids, in accordance with embodiments disclosed herein.

Referring now to FIG. 3, a side view of an alternate embodiment of a system for enhanced recovery of hydrocarbonaceous fluids is shown. System 300, which may be of similar construction and/or configuration as the systems previously described, may include a surface production facility 302 that produces hydrocarbonaceous fluids 330 from a producing formation 310 by way of a wellbore 308. FIG. 3 also includes a wellhead 322. The producing formation 310 may be surrounded by one or more non-producing formations, such as overburden 314, bed rock 316, and/or other earthen material 318.

FIG. 3 depicts an artificial formation 312 formed adjacent to the producing formation 310, which may be conditioned using methods such as fracturing, acidizing, etc., that may facilitate creation of the artificial formation 312. The artificial formation 312 may include various structures, such as, for example, at least two wellbores 304, 306 and a conduit 328. The wellbores 304, 306 and/or the conduit 328 may have a solution 338 disposed therein, the solution 338 including a pre-existing body of solution, or provided using one or more pumps 320, as described previously. As such, any of the wellbores 304, 306 may be usable to convey fluids to or from the artificial formation 312. The electrodes 332 as shown in FIG. 3 may have perforations disposed therein for allowing fluid flow. Fluid injection may occur by the conveyance of pressurized fluid through a tube string 333, out the electrode perforations, and into the artificial formation 312.

FIG. 3 also depicts a third wellbore 326, which may be drilled, at least partially, through the producing formation 310 and into the artificial formation 312. In one embodiment, the third wellbore 326 may include a preexisting wellbore used to recover hydrocarbonaceous fluids from the producing formation 310. Accordingly, drilling operations may be used to extend the third wellbore 326 beyond the producing formation 310, while preexisting or additional cementing and/or casing may be used to selectively isolate the third wellbore 326 from the producing formation 310. Thus, the third wellbore 326 may be in fluid communication with the artificial formation 312, isolated from the producing formation 310, or combinations thereof.

The wellbores 304, 306, 326 may each include an electrode 332 therein, such that any of the electrodes 332 may extend at least partially into the solution 338. It should be appreciated that one or more of the electrodes may function as a cathode, and one or more of the electrodes 332 may function as an anode, the operation of which would be known to one of skill in the art. The electrodes 332 may be operatively connected with a power source 324, such as a DC power source or an AC power source, which may be located, for example, at the surface. In one embodiment, the power source 324 may generate single-phase AC. In another embodiment, the power source 324 may generate three-phase AC. The AC signal may be, for example, rectangular, sinusoidal, saw tooth, etc.

The power source 324 may be used to create an electric field through the use of an electric circuit created between the power source 324, electrodes 332, and solution 338, and may include any of the power sources previously described, but is not meant to be limited. Gas may be produced in the artificial formation 312 by an electrolysis process, which may generally be understood as a process that uses an electric current to drive an otherwise non-spontaneous chemical reaction in a medium that contains mobile ions, such as an electrolyte. In this case, the medium may be the solution 338, which may include, for example, salt water or brine.

As such, the electrodes 332 may provide an electrical interface between the power source 324 and the solution 338. In this manner, the power source 324 may be configured to provide the energy to achieve the electrolysis, the further details of which would be understood by one of ordinary skill in the art. Accordingly, generation of an electric field within the solution 338 may initiate a region of exothermic electrochemical reaction at the electrodes 332, in the solution 338, in the artificial formation 312, in the formation 310, and combinations thereof.

The producing formation 310 may include earthen material that has a porosity sufficient to maintain the hydrocarbonaceous fluids 330 within the producing formation 310, while permitting gas from the artificial formation 312 to permeate into the producing formation so that the gas may solvently mix with hydrocarbonaceous fluids 330. As such, generated gas released from the solution 338 may permeate from the artificial formation 312 into the producing formation 310.

For example, in a solution of brine, hydrogen gas may be generated, as illustrated by Equation 1 below:

$$2NaCl+2H_2O \rightarrow 2NaOH+H_2+Cl_2 \quad [1]$$

As hydrogen gas is generated, hydrogen molecules, as a result of the molecules' small size and inherent properties, may permeate through the artificial formation, the producing formation, and into the hydrocarbonaceous fluids. Permeation of hydrogen molecules, or another similar gas, into the hydrocarbonaceous fluids, may decrease the viscosity of the hydrocarbonaceous fluids and increase pressure within the producing formation 310 to enhance and/or enable production of the hydrocarbonaceous fluids. If necessary, the artificial formation 312 may be maintained at a selected pressure to facilitate permeation of the gas into the producing formation 310.

Any components of the system, including the producing and non-producing formations, may be configured with monitoring and sensor capability (not shown), such that the recovery and/or overall operation of the system may be measured, as would be known to one of skill in the art. As such, the system may be optimized as a result of system measurements and analysis thereof. The optimization may include select adjustment of system variables, such as the electric field generated by the power source. For example, the electric field may be adjusted by changing at least one of a current, a voltage, a frequency, and combinations thereof. Other methods of optimization are possible in view of the embodiments described herein, such as the placement of wellbores and/or electrodes.

Because the reaction is exothermic, an additional synergistic effect of the reaction may include dissipation of heat into the formation that further reduces the viscosity of the formation fluids, and further increases pressure in the formation, due to the additional volume of the gas at the heated temperature. The increased volume of the formation fluids may also "break out" hydrocarbonaceous fluids from the formation matrix, whereby the fluids may flow more readily toward the producing wellbore. As a result of increased pressure and reduced viscosity, the hydrocarbonaceous fluids may flow more readily toward the producing wellbore 308, and the fluids may be easier and therefore cheaper to recover to the surface.

Figure 4A:
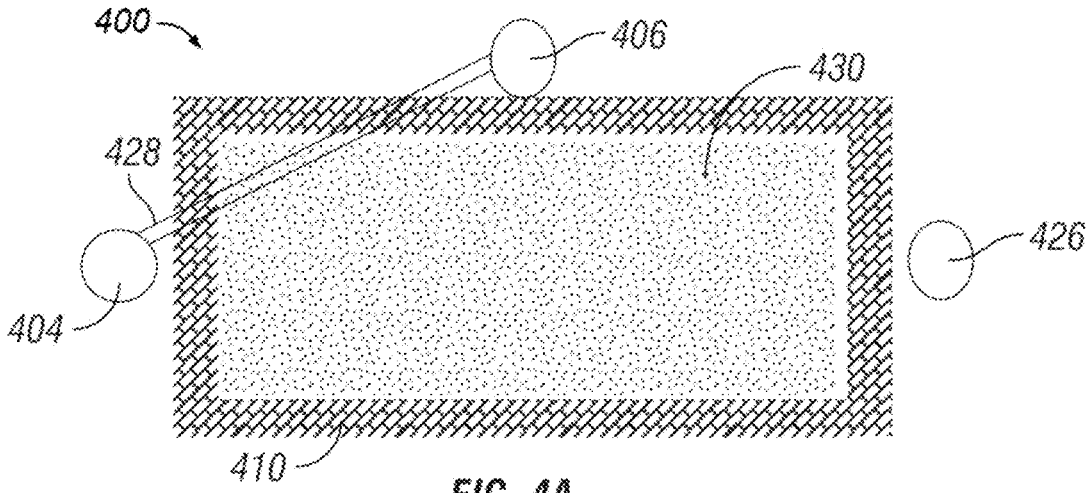
FIGS. 4A-4H show multiple partial downward sectional views of various embodied arrangements of systems useable to enhance recovery of hydrocarbonaceous fluids, in accordance with embodiments disclosed herein.

Referring now to FIGS. 4A-4H, multiple partial downward sectional views of various embodied arrangements of systems useable to enhance recovery of hydrocarbonaceous fluids, according to embodiments of the present disclosure, are shown. FIG. 4A shows a system 400, which may include various features and components previously described but not shown, that may be used to produce hydrocarbonaceous fluids 430 from a producing formation 410 by way of a wellbore. The producing formation 410 may be surrounded by non-producing formations, such as an overburden, bed rock, and/or other earthen material (not shown).

As shown, there may be a plurality of wellbores disposed within or external of the producing formation 410. In the embodiment depicted, an artificial formation may be formed that includes a first wellbore 404 in fluid communication with a second wellbore 406. Fluid communication between the wellbores 404, 406 may be provided, for example, by conduit 428. Additional wellbores may be provided, such as, for example, a wellbore 426, that is part of the system 400, but is not in fluid communication with other wellbores 404, 406; however, it should be understood that another conduit (not shown) may be drilled to connect the wellbore 426 with other wellbores 404, 406 and the conduit 428, as desired.

The wellbores 404, 406, and/or the conduit 428 may have a solution disposed therein, and any of the wellbores that are part of the artificial formation may be used to convey fluids into or from the artificial formation. The wellbores 404, 406, may be configured with an electrode (132, FIG. 1A) disposed therein. As previously described, the electrodes may be used in conjunction with the solution (138, FIG. 1A) to carry out an electrolysis process.

Figure 4B:
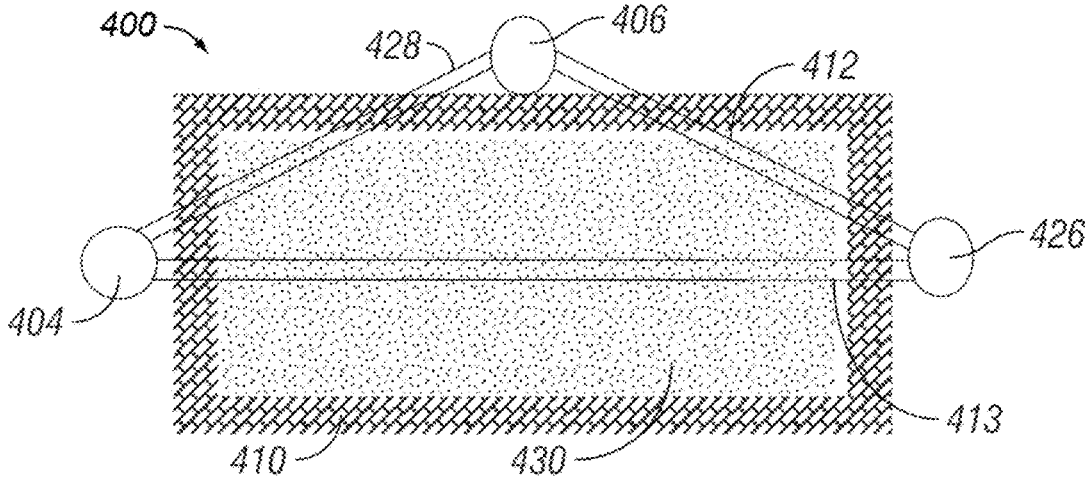

FIGS. 4B-4F together illustrate operational variants and/or various configurations of system 400. FIG. 4B shows each of the wellbores 404, 406, and 426 in fluid communication. The artificial formation is shown including a first conduit 428 formed, at least partially, under the producing formation 410. Alternatively, or in addition, there may be a second conduit 412 and a third conduit 413 formed, at least partially, under the producing formation 410.

Although not illustrated here, the location of the bottom of any of the wellbores and/or conduits may be as previously described. For example, the bottom of the wellbores 404, 406, 426, etc., may fully reside within the producing formation 410. Similarly, conduit 428 may also fully reside within the producing formation 410. In one embodiment, conduit 428 may be a substantially horizontally drilled wellbore. FIG. 4D illustrates wellbores 404, 406, and 426, as well as conduits 428, 412, and 413, disposed within the producing formation 410. Alternatively, the wellbores and connecting conduits may define an artificial formation, which in one embodiment, may reside within, but are fluidly isolated from, the producing formation 410.

Figure 4C:
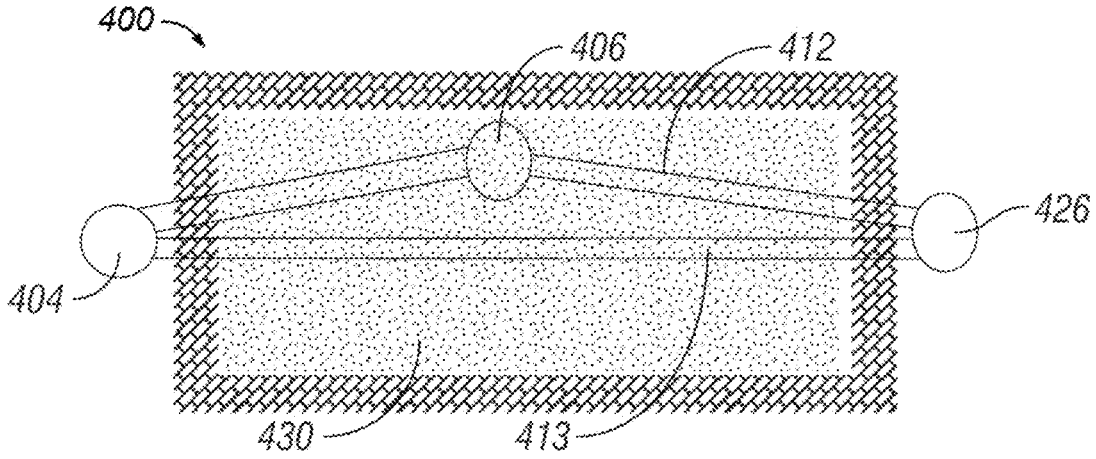
Figure 4D:
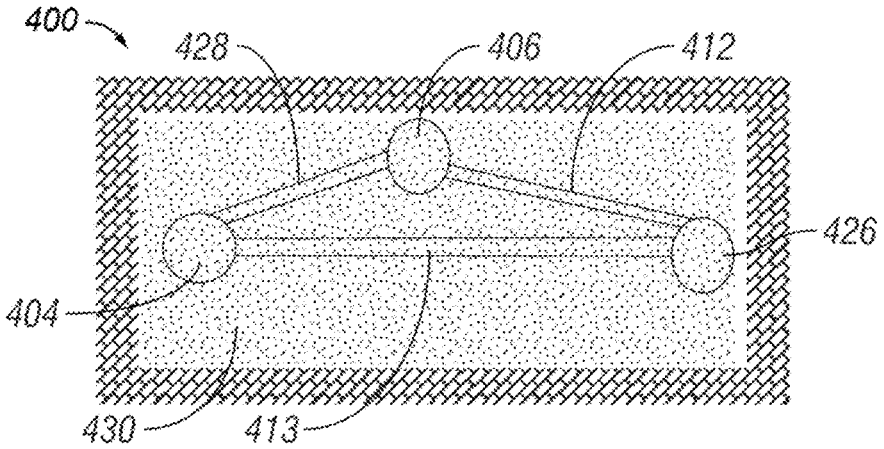

FIG. 4C illustrates an embodiment of the system 400 that may include wellbores 404, 426 disposed external of the producing formation 410, and a wellbore 406 disposed, at least partially, through the producing formation 410. In one embodiment, any of the wellbores disposed at least partially through the producing formation 410 may be formed from a previously producing wellbore. In another embodiment, wellbore(s) may be simultaneously or sequentially used to produce the hydrocarbonaceous fluids 430.

Figure 4E:
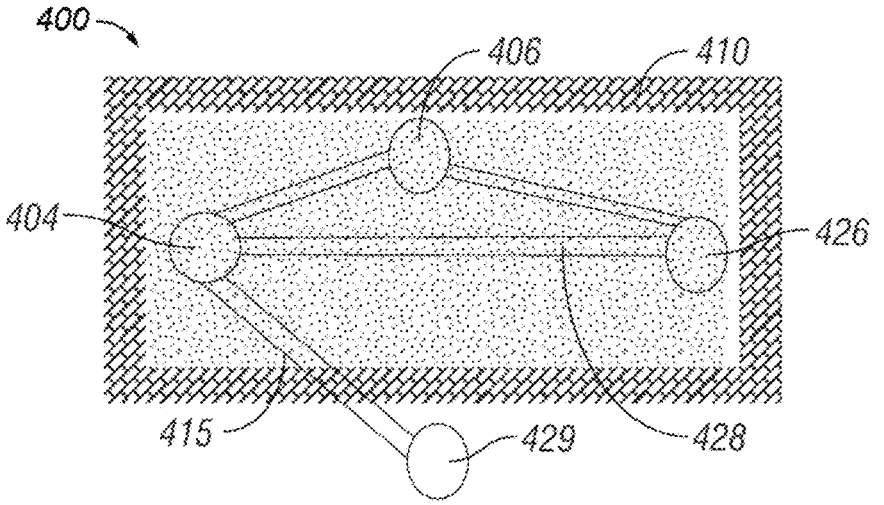
Figure 4F:
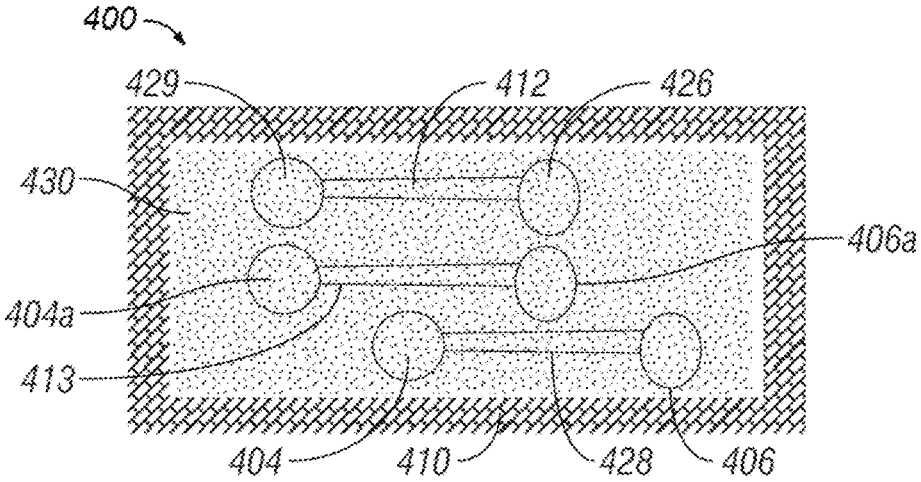

FIG. 4E further illustrates an embodiment of the system 400 that includes a fourth wellbore 429 provided in fluid communication with the other wellbores 404, 406, 426 via a conduit 415. FIG. 4F depicts an alternate embodiment of system 400 whereby wellbores and conduits may be in separately isolated fluid communication. For example, wellbores 404 and 406 may be in fluid communication as a result of conduit 428, while wellbores 404*a* and 406*a* are connected with each other by conduit 413, but are fluidly separated and/or mechanically isolated from wellbores 404, 406.

It should be understood that the system 400 is not limited to any specific number or configuration of wellbores and/or electrodes 432 so that any number of wellbores may be configured in fluid communication or fluid isolation with or from other wellbores, as desired. As such, there may be one or more wellbores that may have a corresponding electrode disposed therein, whereby each one of the one or more wellbores are fluidly disconnected or isolated from one another.

Figure 4G:
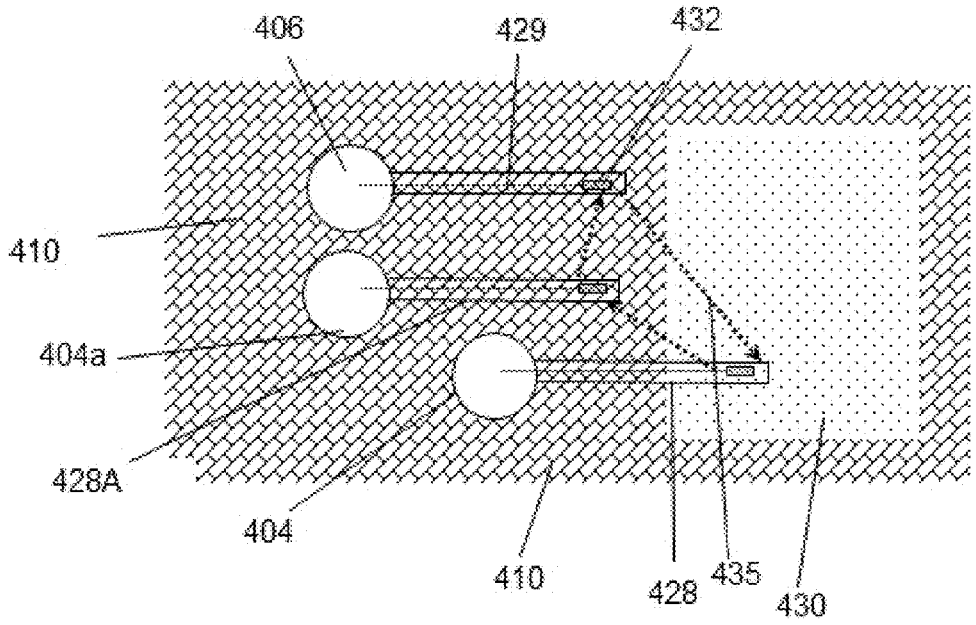
Figure 4H:
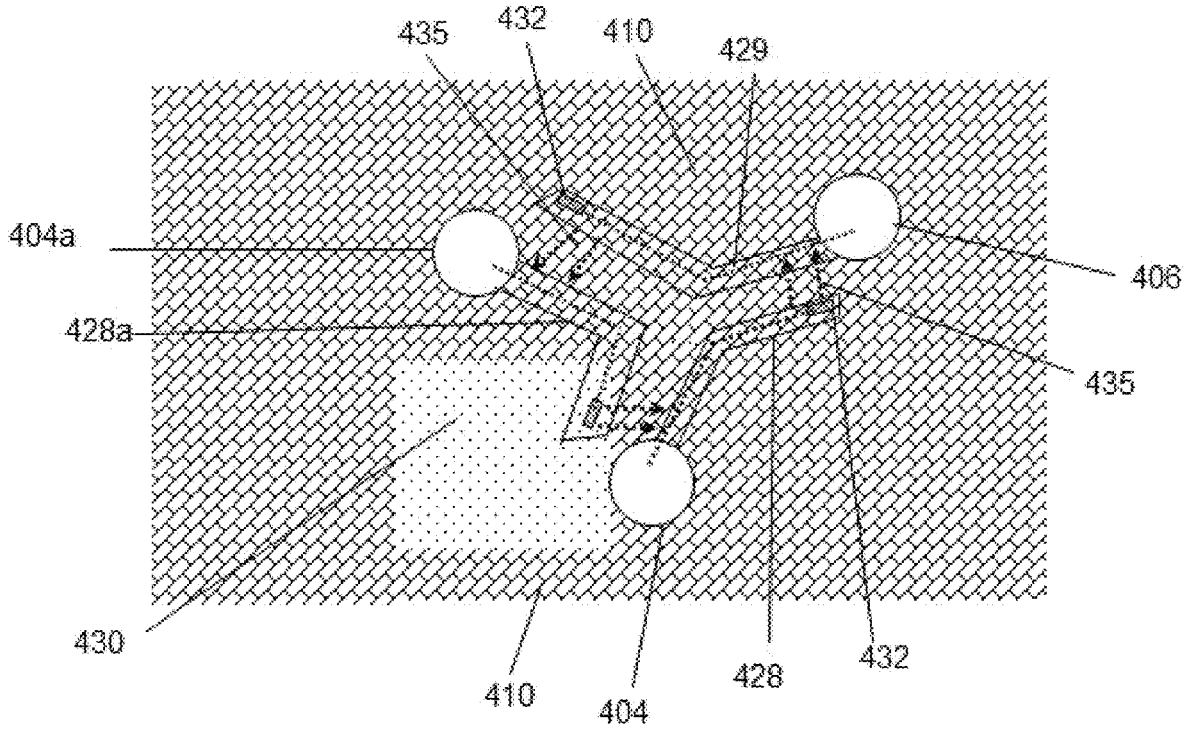

FIGS. 4G and 4H illustrate embodiments where wellbores 404, 404A, and 406 are not fluidly connected (e.g., fluidly isolated) and/or mechanically isolated (e.g., disconnected) from each other. As shown, there may be formation 410 in-between, at least partially, each of the wellbores 404, 404A, and 406, as well as corresponding conduits 428, 428A and 429, respectively. In particular, FIG. 4G illustrates a plurality of wellbores disposed at least partially within the producing formation 410. In this embodiment, the three wellbores 404, 404A, and 406 may each have an electrode 432 disposed therein.

As explained previously, the solution may be pumped or otherwise provided into one or more of the wellbores, such that the electrode(s) 432 may extend at least partially therein. A power source operatively connected to the electrodes may then be actuated to produce an electrical field therebetween. In an embodiment of the disclosure, generation of the electrical field may include application of alternating current to the solution. Although the formation 410 may provide a resistive barrier to the generation of the electric circuit between electrodes 432, the formation may not be terminally or infinitely resistive, and accordingly the circuit may still be completed, as illustrated by circuit field lines 435

The electrical field may cause an electrochemical reaction within the solution to create a gas that may solvently mix with in situ hydrocarbonaceous fluids, thereby increasing pressure within the formation and/or decreasing the viscosity of the hydrocarbonaceous fluids. As one example, brine may be provided into the wellbores, and the electrochemical reaction of the solution may form hydrogen gas. The formed gas may freely pass into adjacent formations containing hydrocarbonaceous fluids, mix with hydrocarbonaceous fluids to reduce the viscosity thereof, and increase pressure within the machined flow path, wellbores, and/or adjacent formations.

Figure 9A:
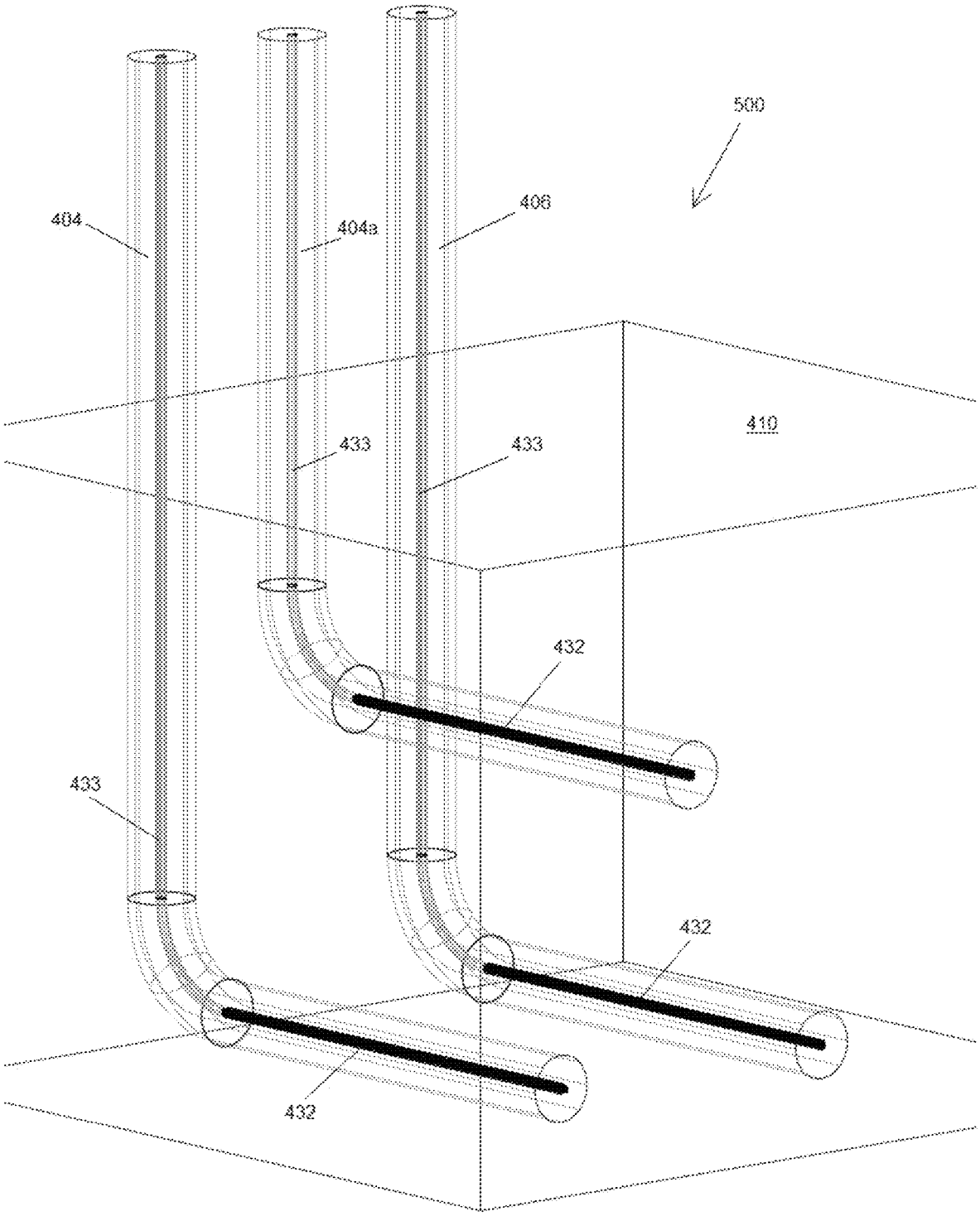
FIGS. 9A-9C show illustrative isometric sectional views of multiple wellbores in mechanical isolation, in accordance with embodiments disclosed herein.

Referring now to FIG. 9A, an isometric cross-sectional view of mechanically disconnected wellbores of a system for enhanced recovery of hydrocarbonaceous fluids, according to embodiments of the present disclosure, are shown. System 500 is shown having three parallel directional wellbores 404, 404*a*, and 406 which are deviating in the horizontal direction at different heights in the producing formation 410. The system 500 is depicted having electrodes 432 extending the length of the horizontal portion of the wellbores. The electrodes may comprise electrical conductors, such as cables, rods, or piping, which are not electrically insulated or covered by an electrical insulation, thus forming an electrode having a length defined by the length of electrical conductor without electrical insulation. FIG. 9A show portions of the insulated electrical conductor 433 located primarily in the vertical portion of the wellbores, wherein the insulation prevents electrical conduction between the conductor and matter in the wellbores that is in contact with the insulation. In alternate embodiment of the system 500, the uninsulated portions of the electrical conductors, or the electrodes 432, may extend along a portion of the horizontal part of the wells. In yet another embodiment of the system 500, the electrodes may extend along both the horizontal and the vertical portions of the well.

Figure 9B:
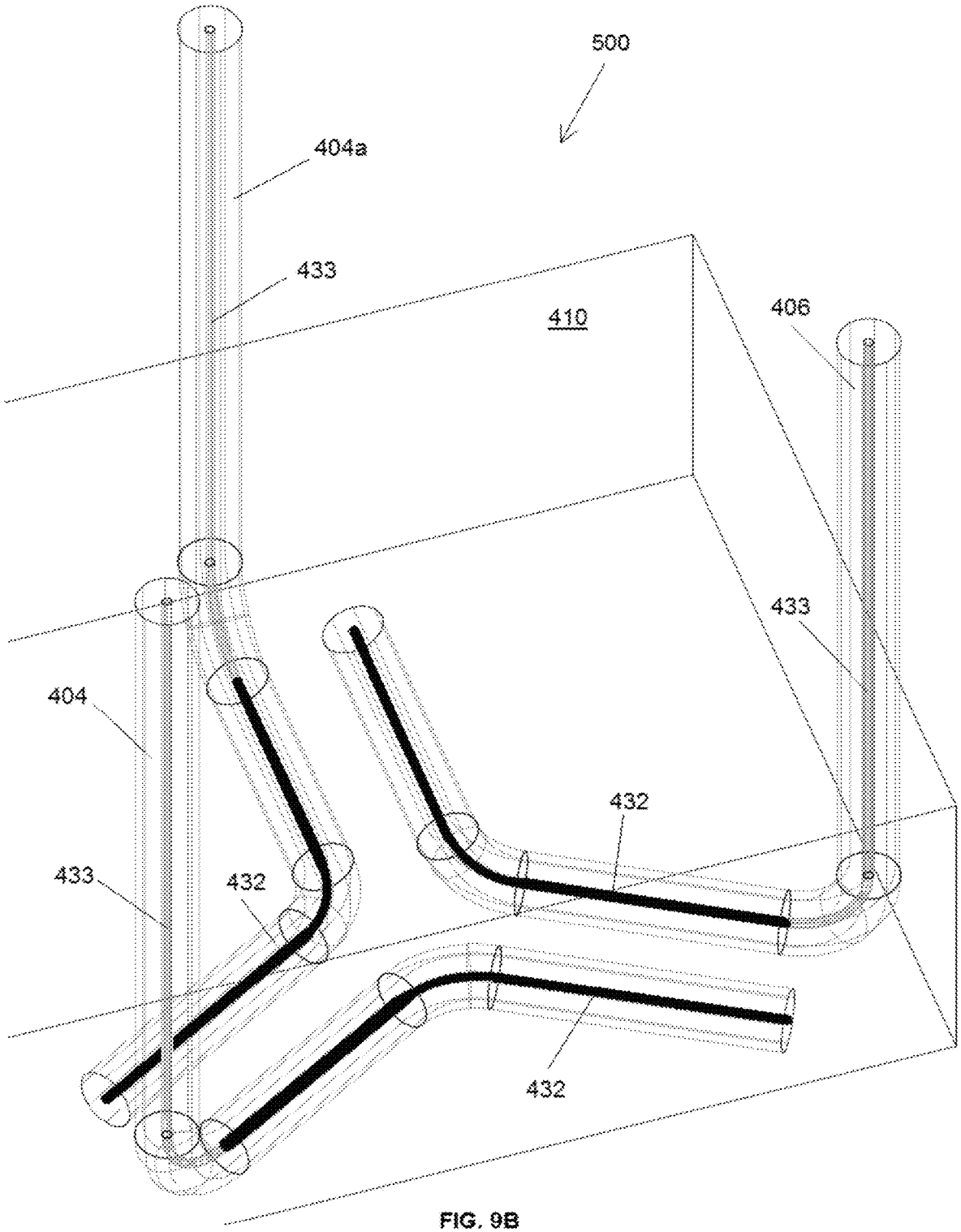

Referring now to FIG. 9B, an isometric cross-sectional view of mechanical disconnected wellbores of a system for enhanced recovery of hydrocarbonaceous fluids, according to embodiments of the present disclosure, are shown. System 500 is shown having three directional wellbores 404, 404*a*, and 406 which are shown deviating in the horizontal direction in the producing formation 410. The system 500 comprises horizontal wellbore portions having a "Y" or a tri-wing configuration. The system 500 is depicted having electrodes 432 extending the length of the horizontal portion of the wellbores. The electrodes may comprise electrical conductors, such as cables, rods, or piping, which are not electrically insulated or covered by an electrical insulation, thus forming an electrode having a length defined by the length of electrical conductor having no electrical insulation. FIG. 9B shows a portion of the insulated electrical conductor 433 located primarily in the vertical portion of the wellbores. In alternate embodiment of the system 500, the uninsulated portion of the electrical conductors, or the electrodes, may extend along portions of the horizontal part of the well. In yet another embodiment of the system 500, the electrodes may extend along both the horizontal and the vertical portions of the wells.

Figure 9C:
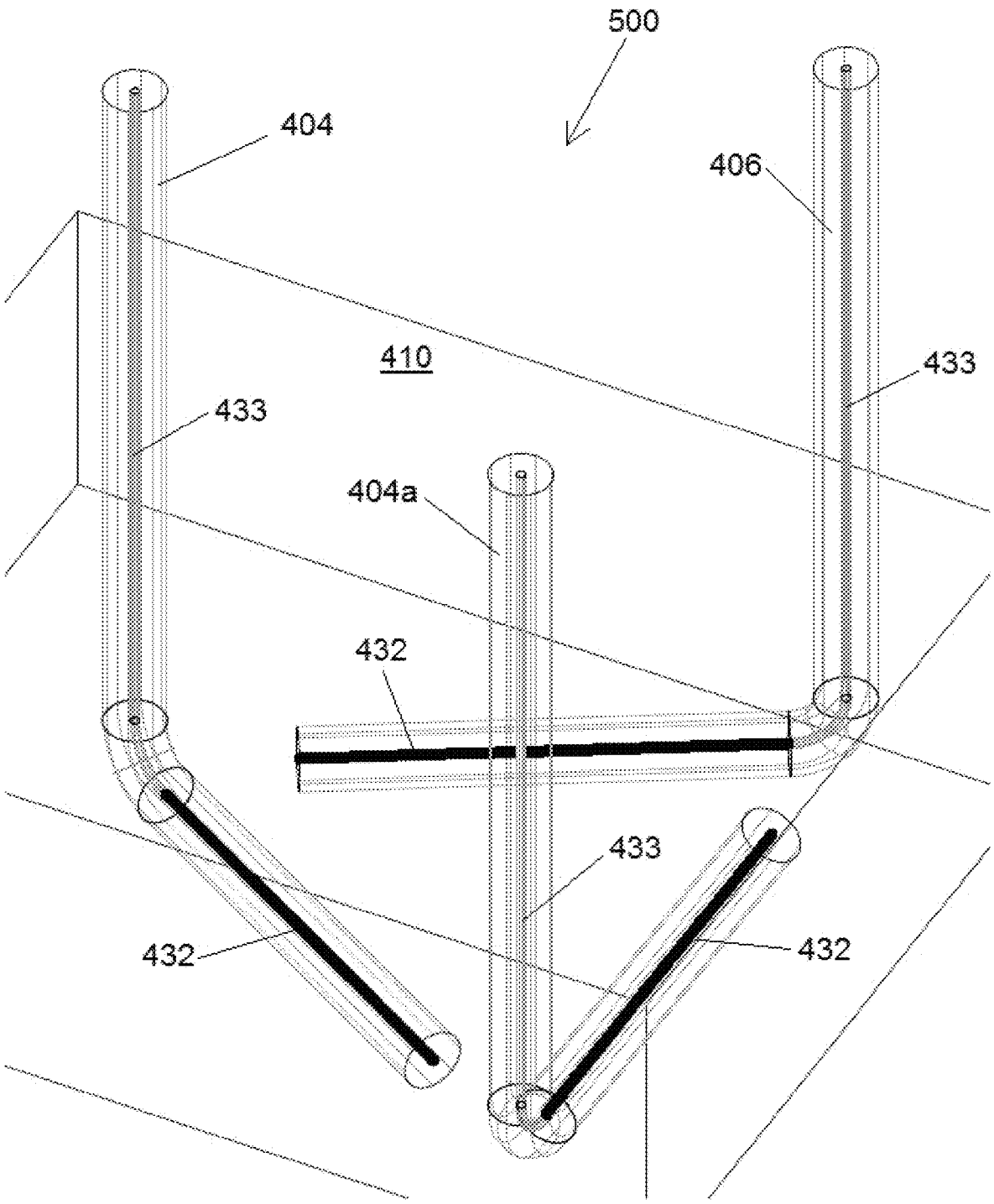

Referring now to FIG. 9C, an isometric cross-sectional view of mechanical disconnected wellbores of a system for enhanced recovery of hydrocarbonaceous fluids, according to embodiments of the present disclosure, are shown. System 500 is shown having three directional wellbores 404, 404*a*, and 406 which are shown deviating in the horizontal direction in the producing formation 410. The system 500 comprises horizontal wellbore portions having a triangular configuration. The system 500 is depicted having electrodes 432 extending the length of the horizontal portion of the wellbores. The electrodes may comprise electrical conductors, such as cables, rods, or piping, which are not electrically insulated or covered by an electrical insulation, thus forming an electrode having a length defined by the length of the electrical conductor having no electrical insulation. FIG. 9C shows a portion of the insulated electrical conductor 433 located primarily in the vertical portions of the wellbores. In alternate embodiments of the system 500, the uninsulated portion of the electrical conductors, or the electrodes 432, may extend along portions of the horizontal part of the wells. In yet another embodiment of the system 500, the electrodes may extend along both the horizontal and the vertical portions of the wells.

Figure 6C:
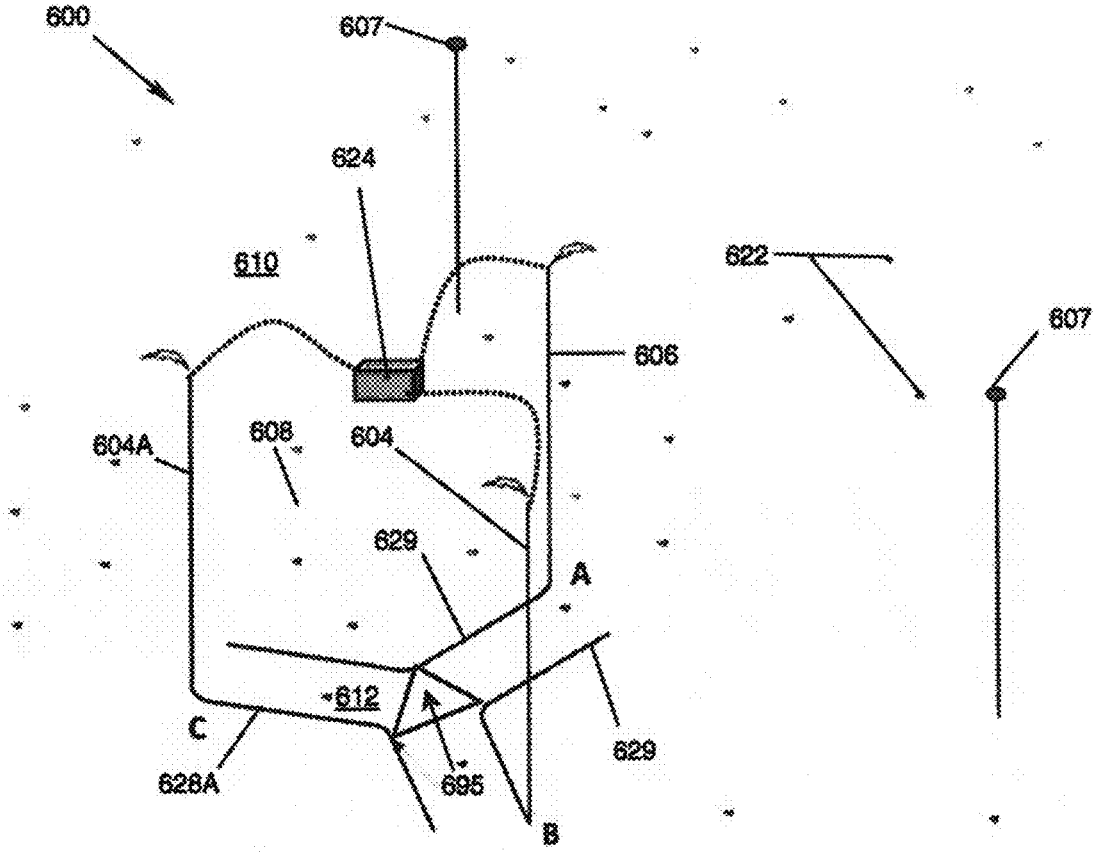
FIG. 6C shows an isometric view of the wellbore configuration of FIG. 6A, in accordance with embodiments disclosed herein.
Figure 6A:
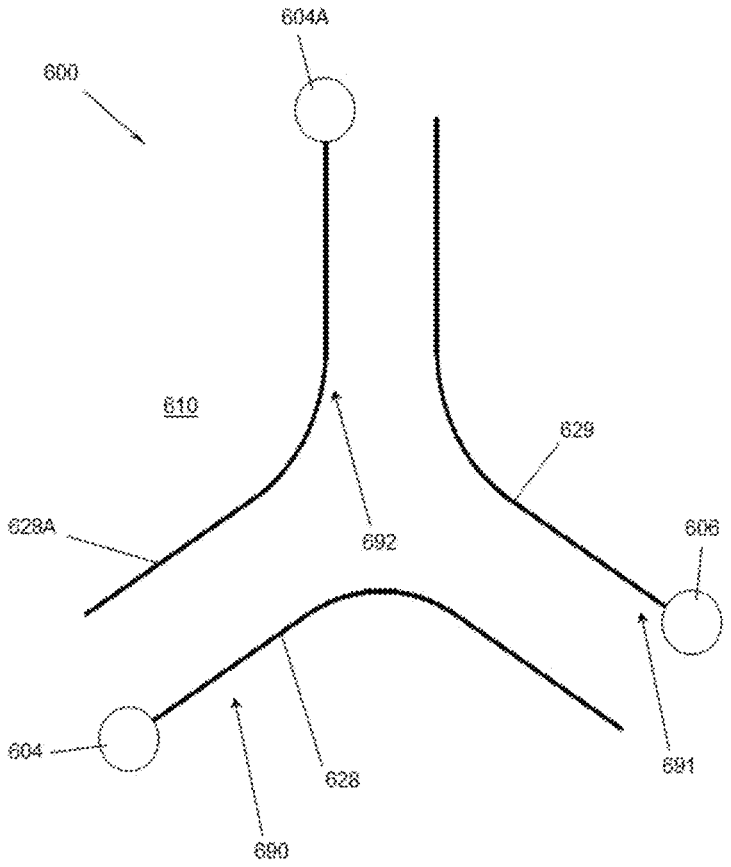
FIGS. 6A and 6B show various downward views of representative wellbore configurations directionally drilled in a subterranean formation, in accordance with embodiments disclosed herein.
Figure 6B:
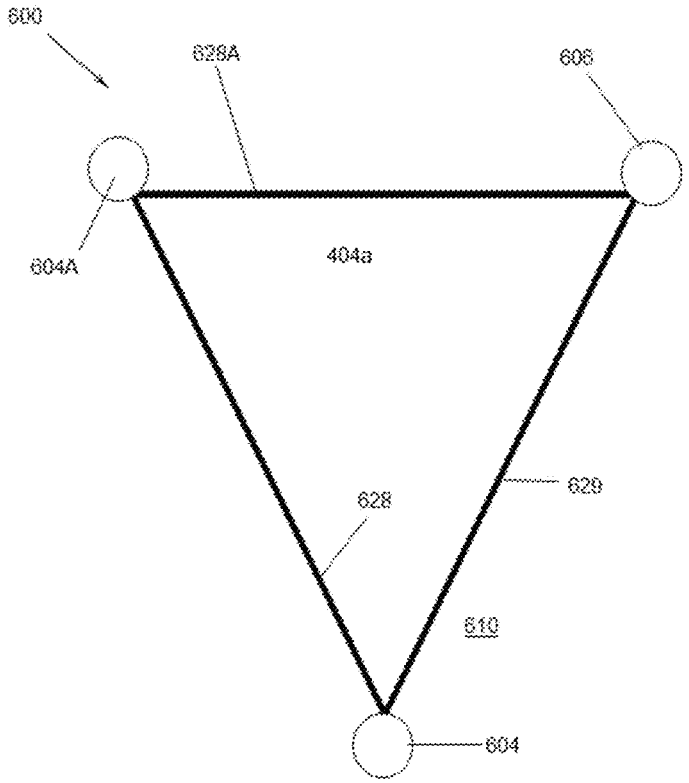

Referring now to FIGS. 6A and 6B, a downward cross-sectional view of mechanically disconnected wellbores, and mechanically connected wellbores, respectively, of a system for enhanced recovery of hydrocarbonaceous fluids, according to embodiments of the present disclosure, are shown. System 600 may be of similar construction and/or configuration as any of the systems previously discussed, and as such, may include one or more wellbores disposed in a producing formation 610. FIG. 6A illustrates three wellbores mechanically disconnected (e.g., mechanically isolated, etc.) from each other, whereas FIG. 6B illustrates three wellbores in fluid communication and mechanical connection with each other, the former resembling a tri-wing or "boomerang" configuration and the latter resembling a triangular configuration. In either or both of these configurations, the wellbores may be electrically or electrochemically connected.

A first wellbore 604 may include a first directionally drilled portion 690, and similarly a second wellbore 606 may include a second directionally drilled portion 691. There may also be additional wellbores with directionally drilled portions, such as a third wellbore 604A configured with a third directionally drilled portion 692.

In the tri-wing configuration, any of the wellbores 604, 604A, and 606 may have portions that may be offset from one or more of the others, such as conduit portions 628, 628A, and 629 associated therewith. The directionally drilled portions may include in entirety and/or partially conduits 628, 628A, and 629.

The conduits 628, 628A, and 629, which may be separated or unconnected from each other, may be configured such that there may be formation 610 between, at least partially, each of the wellbores. The wellbores 604, 604A, and 606 and/or the conduits may contain a solution (not shown), as well as an electrode (not shown), disposed therein, as described previously. In an embodiment, the wellbores may be configured as an electrode in and of themselves, such as by being an elongated conducting material.

Figure 6D:
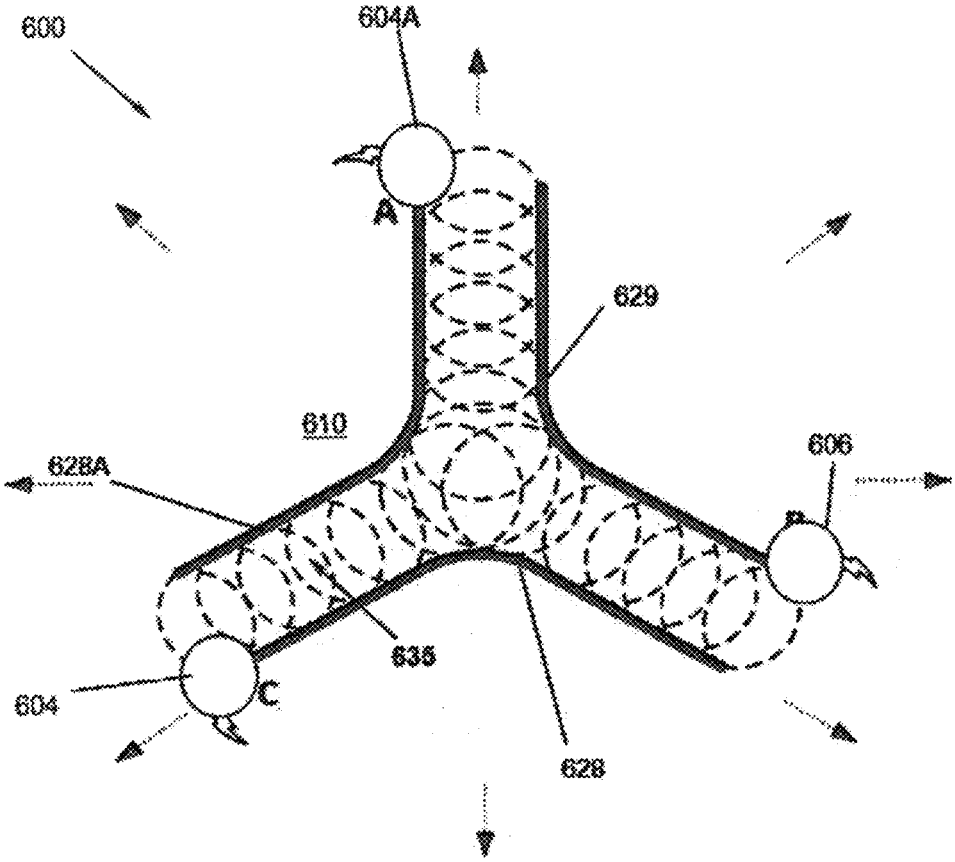
FIGS. 6D and 6E show illustrative views of an electrical field generated between one or more wellbores, in accordance with embodiments disclosed herein.

The tri-wing configuration is further exemplified by FIGS. 6C and 6D together. As shown, the a tri-wing configuration of wellbores may result in a tri-wing, chevron, Y-shape, or "boomerang" shaped completion of an electrical circuit that may be used to enhance recovery. FIG. 6C, which depicts an isometric view of system 600, illustrates the wellbores 604, 604A, and 606 may be at least partially disposed within or through the producing formation 610, along with conduits 628, 628A, and 629. The distances of these subsurface paths may stretch thousands of feet. In an embodiment, there may be an apex region 695 formed at least partially between two or more of the portions 690, 691, and/or 692.

The producing formation 610 may be configured with a fresh water flood or a gas injection process (e.g., carbon dioxide injection) that includes injection wells 607, such that embodiments disclosed herein may readily provide for the conversion of these systems to that of a saltwater flood (or flood with other comparable electrolyte). The saltwater flood may be accomplished to provide an electrolytic path formed within the producing formation 610. As such, an artificial formation 612, which may include, for example, the conduits, may be formed in the presence of pre-existing aqueous solutions, such as saltwater, brine, etc.

Figure 6E:
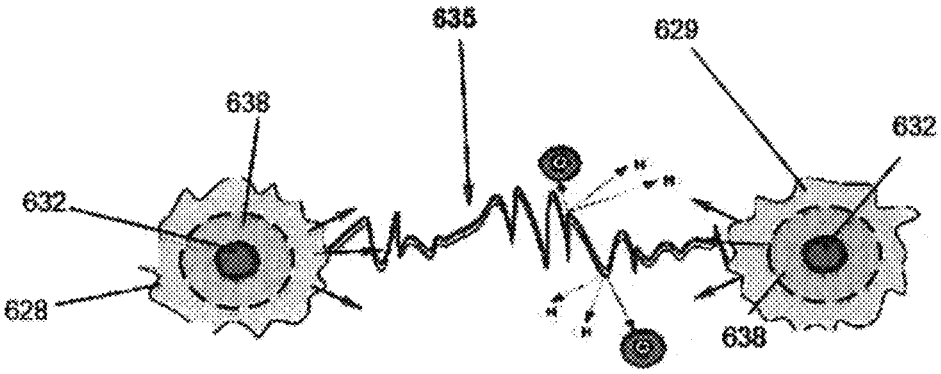

As depicted in FIGS. 6C through 6E, a power source 624 may be used to create an electric field 635 via an electric circuit created by the power source 624, electrodes 632, solution 638 (as shown in FIG. 6E), conduit 628, formation 610, etc., as previously described. As a result of resistive properties, the action of the electrical current passing through the circuit and/or field may heat the formation 610. In addition, the electrochemical reactions may provide increased internal pressure within the formation 610 to thereby drive hydrocarbonaceous fluids into a producing wellbore 608.

Pressure within the wellbore(s) may be sufficient enough to disperse solution (and/or gas formed by electrolysis) out into the producing formation 610, such that the circuit may be completed even though there is formation 610 between the electrodes. The ability to drive solution into the producing formation 610 may help broaden the area of where the electrolysis process may occur. Thus, the electrochemical reaction may occur within the formation 610 in an area that is much greater than the area defined by the conduit(s) 628, 628A, 629.

The electrochemical process, and the aforementioned phenomena that may result from the process, may be utilized in order to create an effect in the formation 610 that may re-establishes a driving force within the formation. The reaction(s) may enhance formation pressures as a result of disassociation of molecules, such as the disassociation of free hydrogen and oxygen from the naturally occurring formation water and the solution. Modest amounts of any gases entrained in the formation 610 may also be released.

As such, the electrochemical process may create additional gas(es) within the formation, whereby the new gas may result in increased formation pressure. By way of example, the new gases may be hydrogen and oxygen, which may be generated from the breakdown of water found in both the naturally occurring water of the formation, as well as any introduced solution. Formation water, interstitial water, etc. may be a naturally occurring water electrolyte located in, for example, pore spaces of the formation, and may not have been present when the formation was formed. This water may have a saline electrolyte that may act as a conductor of electrical current.

Embodiments disclosed herein may produce significant amounts of gases, such as hydrogen and oxygen, as a result of the electrochemical reactions in the zone between those electrodes. In these zones, which may be between one or more of the electrodes, the electrochemical reaction may propagates through the solution, formation water, connate water, etc., which may have mixed with hydrocarbonaceous fluids in the rock formation.

Connate water is trapped in the pores of a rock during formation of the rock. The chemistry of connate water can change in composition throughout the history of the rock. Connate water can be dense and saline compared with seawater. Formation water, or interstitial water, in contrast, is simply water found in the pore spaces of a rock, and might not have been present when the rock was formed. Connate water is also described as fossil water.

This propagation of AC current in the zone between the horizontal electrodes will cause the disassociation of significant quantities of free gases. The below figure illustrates the Process's assumed lines of electrical current flow (the dashed black lines) between the electrodes, and its shaded area demonstrates the cumulative effects of the electrochemical reactions propagating throughout the formation.

FIG. 6E illustrates how freed oxygen and hydrogen may migrate throughout the formation, whereby some of the freed gas may combine with other gases, such as carbon, and form CO2. In this aspect, the CO2 may dissolve in the hydrocarbonaceous fluids, which may expand the volume of the fluids, reduce the fluid viscosity, and/or increase formation pressure. Any freed hydrogen may also increase formation pressure, thereby further enhancing the overall effect of the process. Much of these freed gases may be produced with the formation fluids as the fluids are recovered via wellbores 608. In some embodiments, gases may be separated from the formation fluids, and re-injected into the formation through the injection wells 607 (see FIG. 6C).

Test Results

Conventional electrolysis systems used wells spaced 100 feet apart, whereby the process elevated formation pressures (up to 300 psi increases) over an area of approximately 600 acres or more, and as far away as 4,000 feet from the vertical well electrodes. This large area of coverage occurred after approximately 60 days of near continuous operation and the total application of 120 MWh during that time.

However, data obtained from tests of the present disclosure shows that within only a few days from the start of this test, pressure increases were recorded in wells 600 to 800 feet away. A test of a tri-wing configuration, whereby wells formed in a triangle with 200 feet between each other were found to be more efficient than any previous systems. In the tri-wing configuration, 40 MWh of energy was introduced into the formation, leading to substantial formation pressure increases as far as 8,000 to 10,000 feet away. This improved efficiency was attributed to the increase in power distribution resulting from the electrical field's larger coverage area based on the geometry of the triangle and/or tri-wing configuration. Power usage in the range of 30 to 40 MWh per day (or more) far exceeds conventional electrolysis processes.

In addition, whereas conventional systems relied upon, and were conditional upon and limited to a need for, a significant amount of formation water electrolyte already native to the geologic layer below the oil formation. In contrast, embodiments disclosed herein beneficially enables introduction of significant volumes of electrolyte solution anywhere in the formation. As such, embodiments disclosed herein to not require, nor rely on, the presence of water (or the like) in the formation.

In addition to the wellbores shown, other wellbores may be drilled in order to provide multiple conductive paths within a given formation that may then be used to achieve an optimization for the enhanced recovery of the formation. The configuration of any of the wellbores and subterranean paths may be contingent upon, for example, the particular attributes of a specific field, the characteristics of the formation, and the design (i.e., configuration) of the subsurface electrical circuit.

As FIG. 6C indicates, the paths for the electrodes may be arrayed or situated in the formation in such a manner that the coverage area of the process should be significant. In addition to the paths, the above diagram also shows small triangles 622 at the surface that represent the wellheads of existing vertical production wells in the field. As the cumulative effects of the electrochemical process propagate through the formation 610, hydrocarbonaceous fluid flow to these existing wells will significantly increase.

Initially, system 600 may require onsite electrical generation, such as in the form of a conventional diesel or gas generator(s) specifically sized to produce electricity amounts appropriate for the prospective field. This onsite generation may provide a reliable, independent electricity source that system 600 may use to precisely control system needs. Because the process may create gases such as hydrogen in the formation, and the gas may be created in an already compressed environment, there may be an avoidance of substantial compression costs as compared to traditional methods of hydrogen production.

Figure 5A:
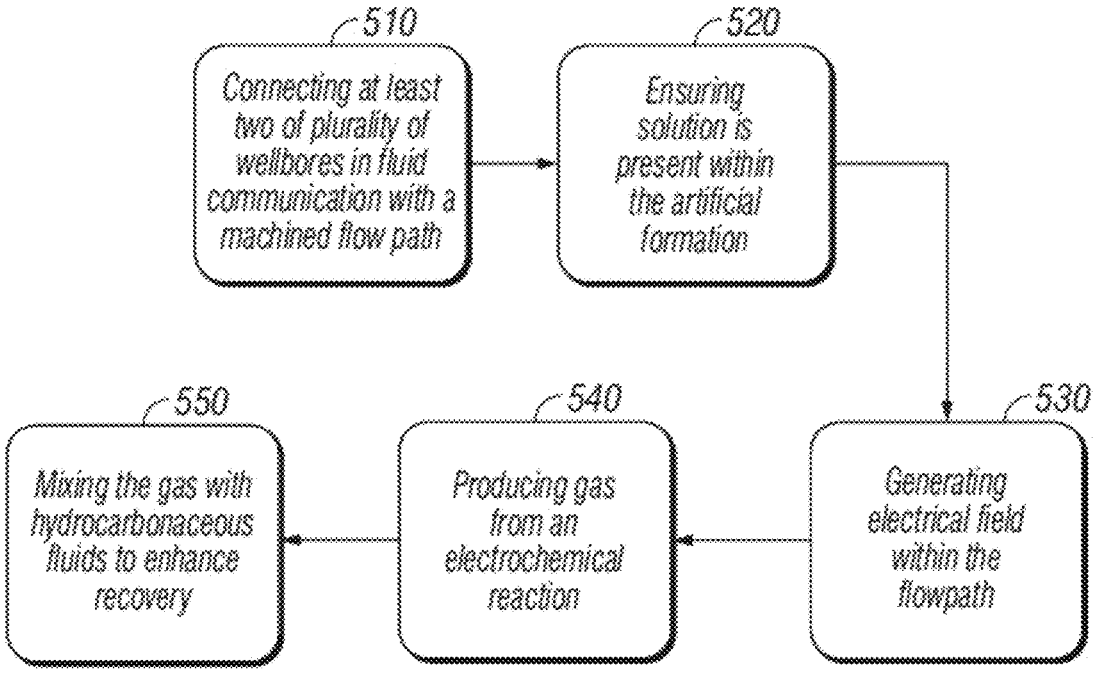
FIGS. 5A and 5B depict flow charts illustrating embodiments of methods for enhanced recovery of hydrocarbonaceous fluids, in accordance with embodiments disclosed herein.

Referring to FIG. 5A, a flow chart illustrating an embodiment of a method for enhanced recovery of hydrocarbonaceous fluids according to embodiments of the present disclosure, is shown. As previously described, there may be a producing formation that has a number of producing wellbores used for the recovery of hydrocarbonaceous fluids from the formation. To enhance recovery of the producing formation, an artificial formation may be created adjacent to the producing formation.

The artificial formation may include a number of man-made or machined components, such as a plurality of wellbores and/or directionally drilled flow paths. Step 510 may include at least two of the plurality of wellbores in fluid communication with at least one flow path. In some embodiments, at least one of the flow paths may be substantially horizontal. In other embodiments, there may be a plurality of wellbores formed and/or connected in a triangulated pattern. Thus, there may be fluid communication between at least three non-producing wellbores.

A solution may pre-exist within the artificial formation, or solution may be provided thereto, as shown by step 520. Thus, the method may include providing a surface solution to any of the wellbores and/or flow paths within the artificial formation. The method may further include steps 530 and 540, which provide for generating an electrical field within the flow path, thereby causing an electrochemical reaction to produce a gas from the solution. In one embodiment, the solution may be an electrolyte, such as brine. In another embodiment, the solution may help conduct electricity between any of the plurality of electrodes.

After producing the gas from the solution, the gas may permeate out from the artificial formation, and into the producing formation. Once the gas enters the producing formation, the gas may be solvent to and/or mix with the hydrocarbonaceous fluids, as indicated by step 550. Accordingly, the production of gas may increase pressures within any part of the artificial formation, the producing formation, or combinations thereof, thereby enhancing recovery of the hydrocarbonaceous fluids.

The electrical field, and hence the electrochemical reaction, may occur as a result of a power source operably connected to a plurality electrodes. In other embodiments, the power source may be an AC source that provides alternating current to the solution. The power source may provide, for example, a voltage of predetermined magnitude, for example, up to several thousand volts. Once the power source is activated, a current flow of, for example, one thousand amperes may flow between electrodes. In an embodiment, the current may flow between the electrodes via a medium disposed in the artificial formation. In a further embodiment, the medium may be brine, and application of the electrical field applied to the brine may produce hydrogen gas.

Figure 5B:
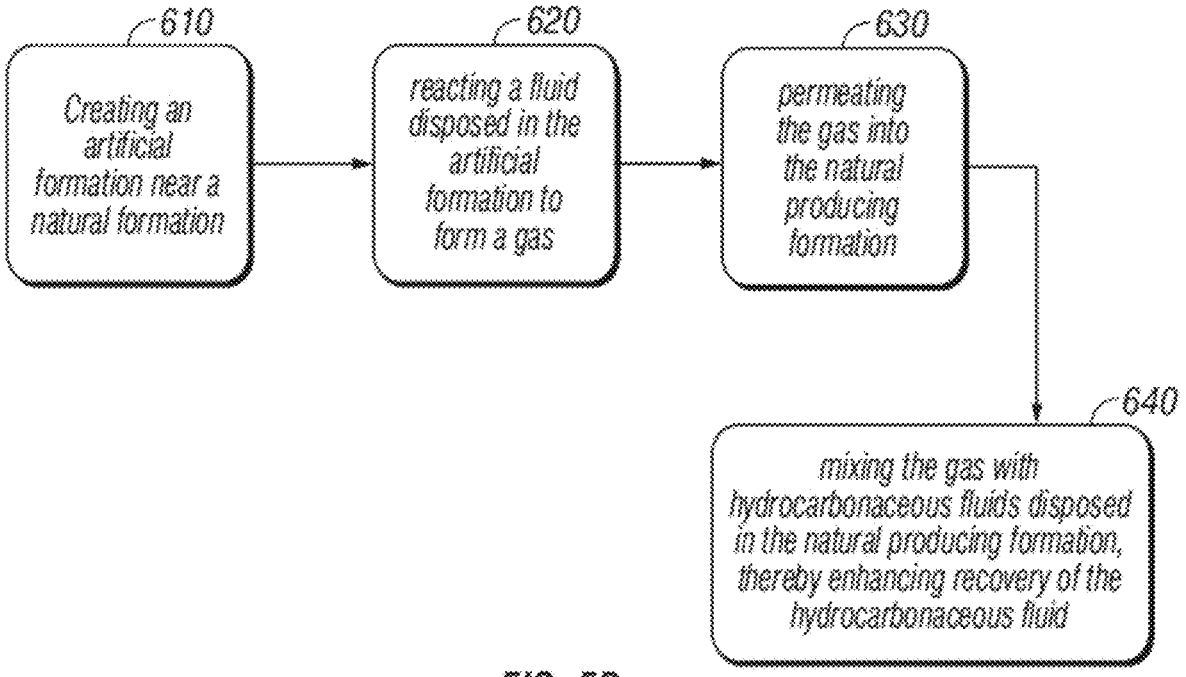

Referring to FIG. 5B, a flow chart illustrating multiple steps of a method for tertiary recovery of hydrocarbonaceous fluids according to embodiments of the present disclosure, is shown. The method may include step 610 of creating an artificial subterranean formation at least partially underneath a non-artificial producing formation, step 620 reacting a solution disposed in the artificial formation to form a gas, and step 630 permeating the gas into the producing formation, such that the permeated gas in the producing formation increases pressure within the producing formation.

In one embodiment, the artificial subterranean formation may include three wellbores in fluid communication, such that a triangulated wellbore pattern may be formed. In other embodiments, each of the wellbores may be mechanically isolated from one another. Each of the three wellbores may include electrodes configured therein, and usable to provide polarization to the solution. In another embodiment, the artificial subterranean formation may include a plurality of wellbores, with at least two of the plurality of wellbores in fluid communication as a result of a horizontally drilled conduit formed directly underneath a natural producing formation.

Solution in the artificial formation may react to produce a gas as a result of an electrolysis process created by an electric field generated within the artificial subterranean formation. In one embodiment, the solution may be brine, and the produced gas may be hydrogen. However, the solution and produced gas are not meant to be limited, and there may be other solutions that produce other gases that are capable of permeating from the artificial formation into the producing formation. Step 640 provides for mixing the gas with hydrocarbonaceous fluids disposed in the natural producing formation, thereby enhancing recovery of the hydrocarbonaceous fluid.

The mixing of hydrogen gas into the hydrocarbonaceous fluids may advantageously increase the producing formation pressure, and may advantageously help release hydrocarbonaceous fluids from the formation matrix. Accordingly, gas may beneficially mix with the fluids thereby reducing the viscosity of the fluids. Production of gases within a producing formation may advantageously provide energy within the formation to repressurize the formation if the natural energy is no longer adequate to overcome the resistive forces.

Figure 7A:
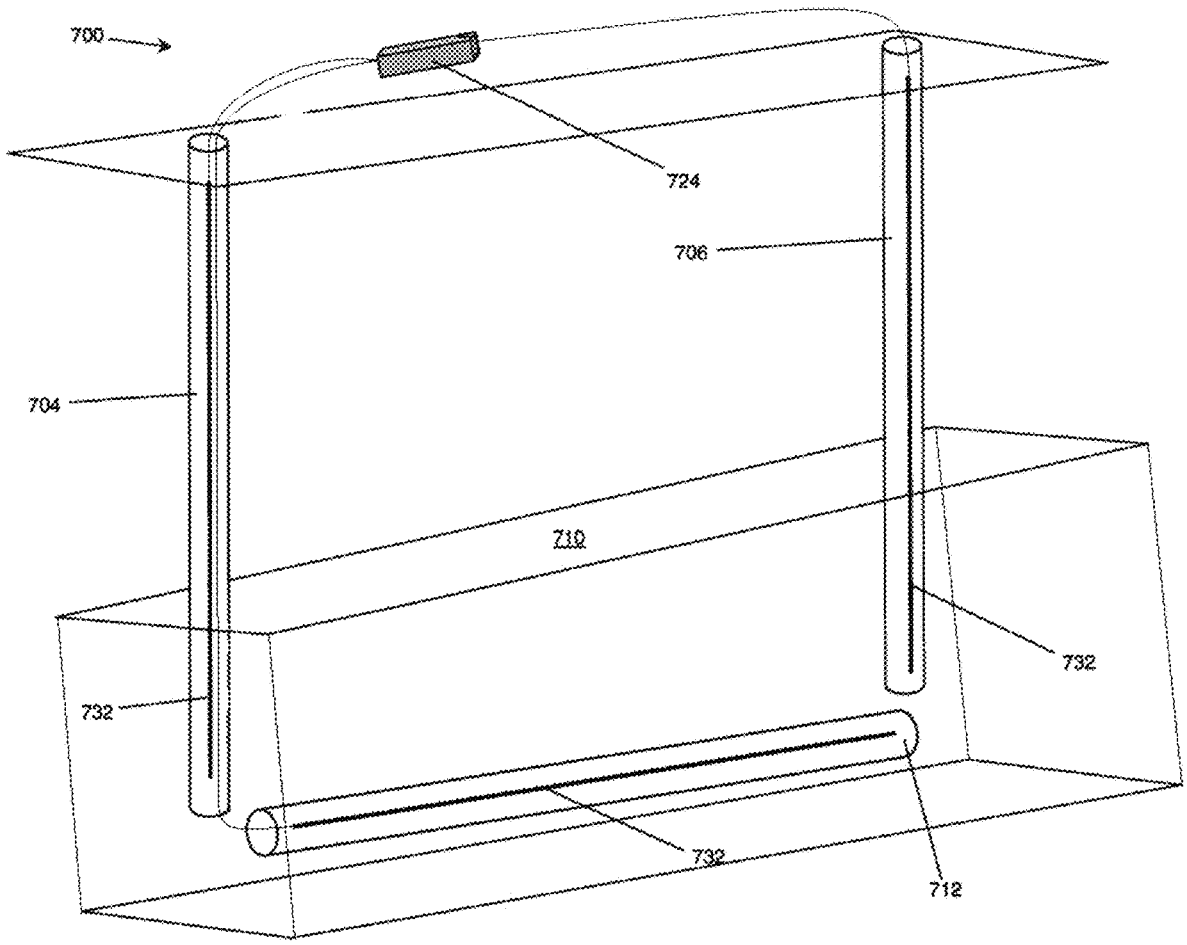
FIGS. 7A and 7B show various views of arrangements and configurations of systems useable to enhance recovery of hydrocarbonaceous fluids, in accordance with embodiments disclosed herein.
Figure 7B:
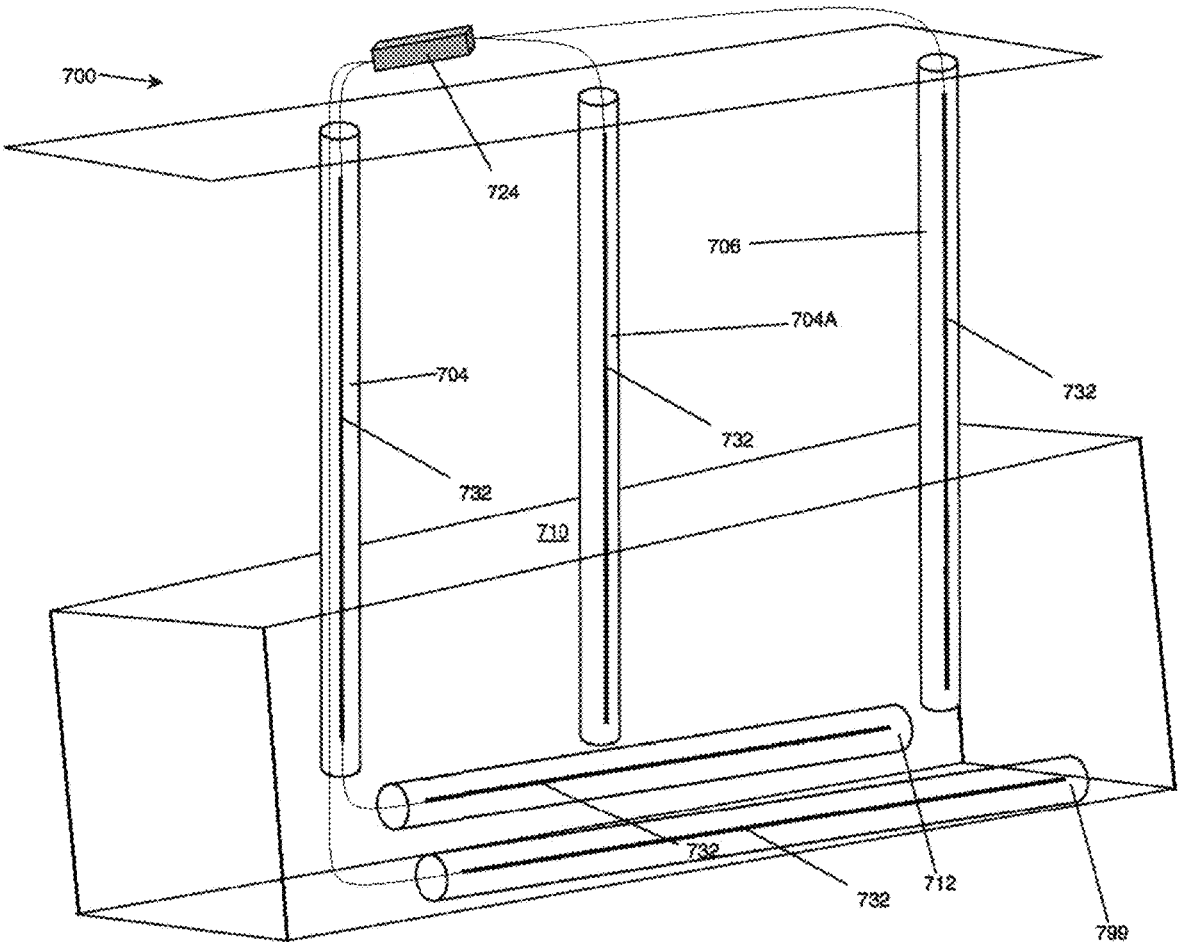

Referring now to FIGS. 7A and 7B, various views of arrangements and configurations of systems useable to enhance recovery of hydrocarbonaceous fluids, according to embodiments of the present disclosure, are shown. FIG. 7A shows a system 700, which may be of a similar construction and/or configuration as any of the systems previously described. As such, there may be one or more sections of producing formation 710 that may be surrounded by one or more non-producing formations, such as overburden, bed rock, and/or other earthen material.

At least one non-vertical wellbore 712 may be formed within (e.g., in the vicinity of, as part of, etc.) or near the producing formation 710, as well as one or more wellbores 704 and 706 that have a different orientation in the formation with respect to wellbore 712. In some embodiments, the orientation of the wellbore 712 with respect to wellbores 704 and 706 may be perpendicular. In other embodiments, the at least one non-vertical wellbore 712 may be in fluid communication with any of the wellbores 704, 706.

The wellbores 704, 706, 712, etc. be formed with conventional drilling methods, such that the wellbores may be pressurized (including use of wellheads, etc.), cased, cemented, perforated, etc., as would be understood to one of skill in the art. It should be understood that in certain embodiments, one or more of the wellbores may be left uncased, uncemented, or otherwise unmodified.

In an embodiment, the wellbores may be at least partially disposed within or through the producing formation, such that the wellbores are independently or simultaneously useable for production of hydrocarbonaceous fluids. The wellbores may be formed in the presence of pre-existing aqueous solutions, such as saltwater, brine, etc.

In an embodiment, the wellbore 712 may be a directionally drilled wellbore. Any of the wellbores 704, 706, and/or 712 may have an electrode 732 disposed therein. In an embodiment, the electrodes may be disposed in, at least partially, a solution (not shown). The electrodes 732 may be disposed within the wellbores in any fashion. For example, the electrodes 732 may be configured as an elongate member disposed therein. The electrodes 732 may be positioned within the wellbores by way of, for example, downhole tools. In addition, the electrodes may be maintained in any desired position as well as in connection with the corresponding wellbore by way of anchoring devices or the like.

As shown, the electrodes 732 may be operatively connected with a power source 724, which may be located at the surface or another location. The power source 724 may be used to create an electric field via an electric circuit created by the power source, electrode(s), and solution.

In some embodiments, any of the wellbores may fluidly connected with one or more additional wellbores, while in other embodiments one or more wellbores may be mechanically disconnected or isolated from one another (e.g., not connected by conduits, wellbores, etc.). In further embodiments, any of the wellbores may be fluidly connected and/or electrochemically connected, but mechanically isolated.

As mentioned, the wellbores may include various orientations, such as horizontal, vertical, angled, and combinations thereof. Briefly, FIG. 7B illustrates an additional vertical wellbore 704A, as well as an additional horizontal wellbore 799. Any of the wellbores may have an electrode 732 disposed therein. The wellbores may each have an electrode 732 disposed therein, such that any of the electrodes 732 may extend at least partially into solution (not shown).

It should be understood that the system(s) 700 is not limited to any specific number or configuration of wellbores and/or electrodes, such that any number of wellbores may be configured in fluid communication or fluid isolation with or from other wellbores, as desired. As such, there may be one or more wellbores that may have a corresponding electrode disposed therein, whereby each one of the one or more wellbores are fluidly disconnected or isolated from one another.

Figure 8:
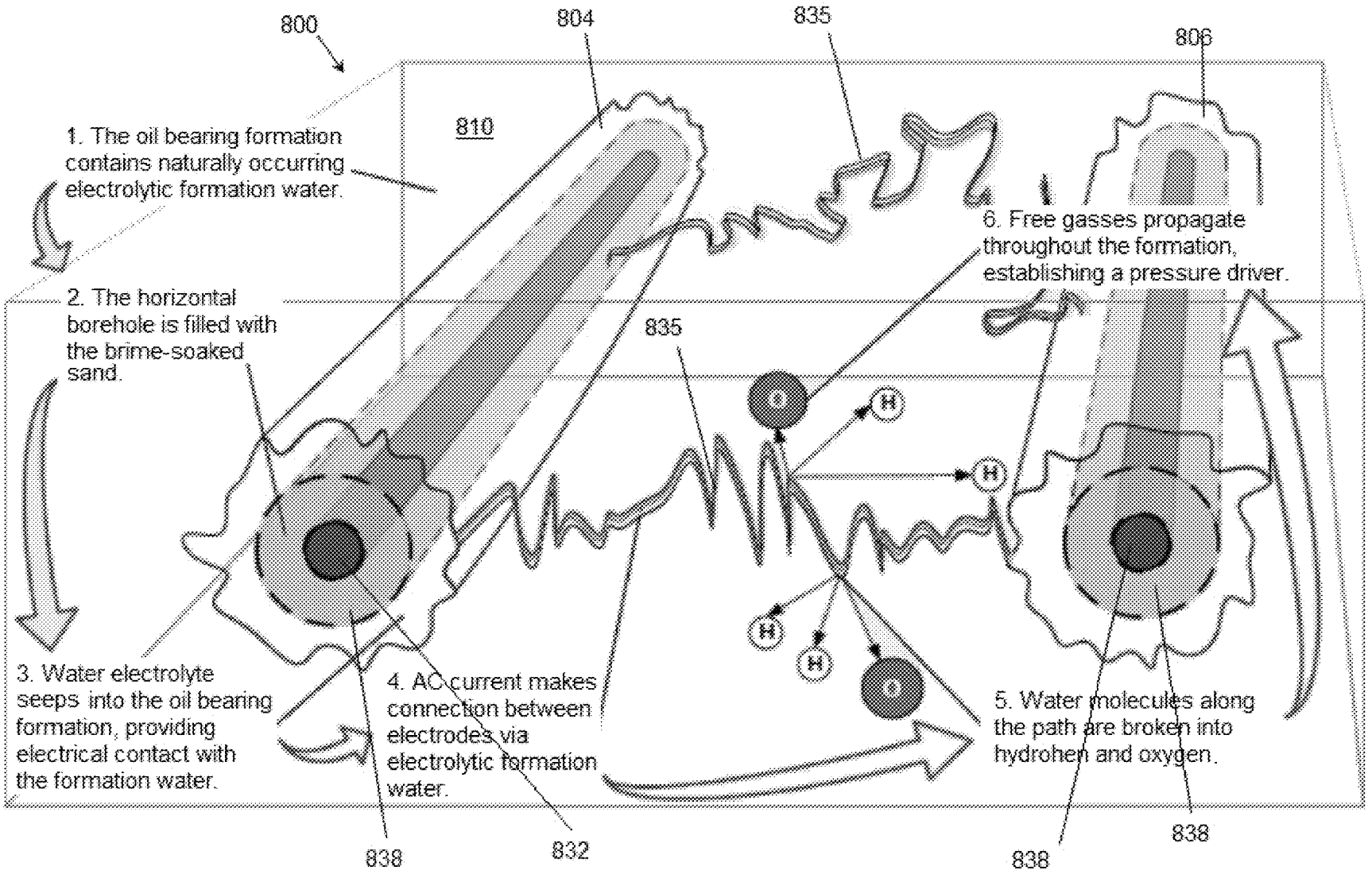
FIG. 8 shows an illustrative lateral side sectional view of multiple wellbores in electrochemical connection, in accordance with embodiments disclosed herein.

Referring now to FIG. 8, a lateral side sectional view of multiple wellbores in electrochemical connection according to embodiments of the present disclosure, is shown. FIG. 8 shows a system 800, which may be of a similar construction and/or configuration as any of the systems previously described. As such, there may be one or more sections of producing formation 810 that may be surrounded by one or more non-producing formations, such as overburden, bed rock, and/or other earthen material.

At least one or more wellbores 804 and 806 may be disposed within or near the formation 810. The wellbores 804, 806 may be formed with conventional drilling methods, such that the wellbores may be pressurized (including use of wellheads, etc.), cased, cemented, perforated, etc., as would be understood to one of skill in the art. It should be understood that in certain embodiments, one or more of the wellbores may be left uncased, uncemented, or otherwise unmodified.

In an embodiment, the wellbores may be at least partially disposed within or through the producing formation, such that the wellbores are independently or simultaneously useable for production of hydrocarbonaceous fluids. The wellbores may be formed in the presence of pre-existing aqueous solutions, such as saltwater, brine, etc.

In an embodiment, the wellbores 804 and/or 806 may be a directionally drilled wellbore. Any of the wellbores 804, 806 may have an electrode 832 configured therein. In an embodiment, the electrodes may be in contact with, at least partially, a solution 838. The electrodes 832 may be disposed within the wellbores in any fashion. For example, the electrodes 832 may be configured as an elongate member disposed therein. The electrodes 832 may be positioned within the wellbores by way of, for example, downhole tools. In addition, the electrodes may be maintained in any desired position as well as in connection with the corresponding wellbore by way of anchoring devices, centralizers, or the like (not shown).

The electrodes 832 may be operatively connected with a power source (not shown), which may be located at the surface or another location. The power source may be used to create an electric field 835 via an electric circuit created by the power source, electrode(s), and solution.

In some embodiments, any of the wellbores may fluidly connected with one or more additional wellbores, while in other embodiments one or more wellbores may be mechanically disconnected or isolated from one another (e.g., not connected by conduits, wellbores, etc.). As shown by way of example in FIG. 8, any of the wellbores 804, 806 may be fluidly connected and/or electrochemically connected, but mechanically isolated. As mentioned, the wellbores may include various orientations, such as horizontal, vertical, angled, and combinations thereof.

It should be understood that the system(s) 800 is not limited to any specific number or configuration of wellbores and/or electrodes, such that any number of wellbores may be configured in fluid communication or fluid isolation with or from other wellbores, as desired.

The electrochemical reaction of the present disclosure may advantageously occur within and/or outside the producing formation, such that the reaction does not depend on constituent elements within the producing formation. Accordingly, systems and methods of the present disclosure have no dependence on any formation properties. There may beneficially include measurement configurations for the select optimization of systems and methods described herein.

Embodiments disclosed herein may provide systems and methods for establishing an electrical field in a subsurface formation, and establishing in response to the electrical field, a zone of electrochemical activity that may result in an electrochemical reaction that increases the formation pressure, reduces the viscosity of any hydrocarbonaceous fluids in the formation, and enhances recovery of the hydrocarbonaceous fluids.

Embodiments herein may beneficially combine modern directional drilling techniques with electricity in order to generate electrochemical activity in an underproducing formation so that production may be revitalized. Other embodiments disclosed herein advantageously use modern drilling techniques in order to direct and optimize electrochemical activity within a previously poorly producing formation.

The application of the systems and methods described herein may be used in formations with anomalous and/or technically challenging geology, which provides the extraordinary effect of: 1) reservoir pressurization, and 2) a reduction of fluid viscosity within the formation, which may beneficially provide a new production driver throughout what was otherwise a stranded formation.

Embodiments disclosed herein are readily and easily modeled. Thus, unlike previous conventional EOR activity that necessarily requires very detailed reservoir modeling before operations begin, the embodiments disclosed herein beneficially do not need a similar level of reservoir detail. For example, embodiments disclosed herein may provide a large three-dimensional field of electrochemical activity inside a formation and does not mechanically introduce or require a new driver from the surface. In contrast, conventional EOR processes mechanically introduce reservoir driver(s) (e.g., CO2) through individual wellbores from the surface; as a result, those methods require detailed reservoir modeling to avoid problems such as channeling.

In contrast, embodiments disclosed herein advantageously require no exploration activity. Thus, these embodiments may beneficially be applied to known hydrocarbon formations that are in a state of decline, abandoned, or otherwise difficult-to-produce, such that there may be significantly enhanced extraction of fluids from these formations. Of other benefit, embodiments disclosed herein may be applicable to onshore, as well as offshore formations.

There are no limitations to size of any of the systems disclosed herein. In addition, these systems beneficially do not require a significant expansion of surface equipment beyond what would normally be expected to accompany an ongoing production operation.

Embodiments disclosed herein may readily use larger megawattage than previously possible because the electrode array configuration may beneficially be much larger in size. Current densities associated with the embodiments disclosed herein may advantageously be maintained at levels that do not generate steam at the electrodes.

Of further significance, embodiments disclosed herein may produce gases that are not limited to the electrical contacts in the reservoir. Instead, freed gases generated by the electrochemical reaction may readily migrate throughout the reservoir, leading to enhanced production beyond areas defined by lines of electrical flow.

Embodiments disclosed herein advantageously generate a hyper-efficient in situ gas flood that may be applied to most of the known stranded formations in the U.S and the world. This process dramatically reduces the costs, limitations, and complexities associated with traditional or otherwise conventional enhanced oil recovery.

Systems and methods of the present disclosure may be used to enhance recovery of approximately 50% to 70% of hydrocarbon reserves presently not economically recoverable. In the U.S. alone, this amounts to approximately 1 trillion barrels of oil, which may be a substantial economic windfall for the US economy as a whole, as well as less dependence on foreign energy import sources.

Embodiments of the present disclosure may favorably produce a pressurized gas flood that may encompass the entirety of the formation and significantly enhances the amount of recoverable fluids in the formation. In addition, the electrochemical activity that provides the in situ generation of gas does not rely on an external source of CO2; therefore, there are no geographic limitations, and systems may be used with and/or applied to any hydrocarbon formation.

Embodiments disclosed herein may beneficially provide systems and methods that dramatically lower costs; provide hyper-efficient coverage of the formation; and significant expansion of the scope of potentially recoverable reserves in comparison to previous known EOR processes.

Embodiments disclosed herein do not require traditional DC electrolysis; instead, AC electricity may be readily used, which beneficially has electric properties that generate electrochemical activity between large horizontal electrodes within the formation.

Advances in horizontal drilling can now provide a very accurate method for the direction of electrical current and the introduction of an electrolyte into a hydrocarbon formation. The electrochemical recovery process includes directionally drilled boreholes, wellbores, conduits, etc. through the formation, whereby they may be filled with an electrolytic solution like salt water. This solution may provide an electrical contact with the naturally occurring formation fluids (e.g., water), thereby allowing current to be conducted between electrodes. In summary, the directionally drilled borehole and injected electrolyte may form a long, pressurized, and relatively stable electrode for electricity to conduct therethrough.

Directionally drilling now allows optimally directed zones of electrochemical activity that will revitalize the formations; and on a cost basis, enable coverage of a much larger area of the formation relative to other recovery conventional EOR techniques. These other recovery techniques are frequently limited by faults, fractures, low permeability, and other geological irregularities that hinder the spread of the EOR influence; however, embodiments disclosed herein advantageously propagate an electrochemical reaction, which does not suffer from these geological detriments.

Each path or conduit drilled through the formation may beneficially become a very long, isolated electrode, through which electrical current may be introduced. A zone of electrochemical activity may propagate through naturally existing formation fluids between the electrodes disposed in the formation.

With embodiments disclosed herein, formation pressure increases may be achieved up to 8,000 to 10,000 feet away, which is a substantial increase over conventional EOR. This improved efficiency was attributed to the increase in power distribution resulting from the electrical field's larger coverage area based on the geometry of the wellbore configuration(s). Embodiments disclosed herein beneficially stimulate the formation with electrochemical activity in the zone between electrodes.

While the present disclosure has been described with respect to a limited number of embodiments, those skilled in the art having benefit of the present disclosure will appreciate that other embodiments may be devised which do not depart from the scope of the disclosure described herein. Accordingly, the scope of the disclosure should be limited only by the claims appended hereto.

What is claimed:

1. A method for tertiary recovery of hydrocarbonaceous fluids, the method comprising:

creating at least part of an artificial subterranean formation external to a natural producing formation;

reacting a fluid disposed in the artificial formation to form a gas;

permeating the gas into the natural producing formation, wherein the permeated gas in the natural producing formation increases pressure within the natural producing formation;

and mixing the gas with hydrocarbonaceous fluids disposed in the natural producing formation, thereby enhancing recovery of the hydrocarbonaceous fluid, and the artificial subterranean formation comprises three wellbores mechanically isolated from each other, each of the three wellbores comprising a corresponding directionally drilled portion, and at least a portion of each of the three directionally drilled portions together form a Y-shape configuration within the natural producing formation.

2. The method of claim 1, wherein each of the three wellbores comprise electrodes disposed therein to provide polarization to the hydrocarbonaceous fluid.

3. The method of claim 1, wherein a renewable energy source produces a current usable to form an electric field within the artificial subterranean formation, and wherein the hydrocarbonaceous fluid reacts as a result of an electrolysis process created by the electric field.

4. The method of claim 1, wherein the artificial formation is entirely external of the natural producing formation.

* * * * *